US006168327B1

(12) United States Patent
Tsuzuki

(10) Patent No.: US 6,168,327 B1
(45) Date of Patent: Jan. 2, 2001

(54) IMAGE FORMING DEVICE

(75) Inventor: Toru Tsuzuki, Nagoya (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/207,266

(22) Filed: Dec. 9, 1998

(30) Foreign Application Priority Data

Dec. 10, 1997 (JP) ..... 9-340093

(51) Int. Cl.[7] ..... B41J 3/60
(52) U.S. Cl. ..... 400/188; 400/582
(58) Field of Search ..... 400/188, 582; 271/288, 184, 185, 186

(56) References Cited

U.S. PATENT DOCUMENTS 4,810,120 * 3/1989 Narita et al. ..... 400/624
4,866,487 * 9/1989 Ohuchi et al. ..... 355/313
4,876,562 10/1989 Suzuki et al. .
4,934,681 * 6/1990 Holmes et al. ..... 271/3
5,196,897 3/1993 Trask .
5,241,397 8/1993 Yamada .
5,731,879 * 3/1998 Maniwa et al. ..... 358/296

* cited by examiner

*Primary Examiner*—John S. Hilten
*Assistant Examiner*—Charles H. Nolan, Jr.
(74) *Attorney, Agent, or Firm*—Oliff & Berridge, PLC

(57) ABSTRACT

A printer including a print engine capable of printing images onto both the front surface and the backside surface of each recording paper. The printer operates as described below while counting, with the copy counter, the number of printed copies. The odd-numbered copy is printed on the front surfaces of the papers form the first page to the last page in this order and is discharged facing downwardly. The even-numbered copy is printed on the backside surfaces of the papers from the last page to the first page in this order an discharged facing upwardly. Accordingly, in the printed matter finally stacked on the discharge tray, the printed sheets are stacked so that the surfaces, on which images are printed, are alternated in the respective copies. In each copy, printed sheets are arranged properly from the first page to the last page in order.

25 Claims, 17 Drawing Sheets

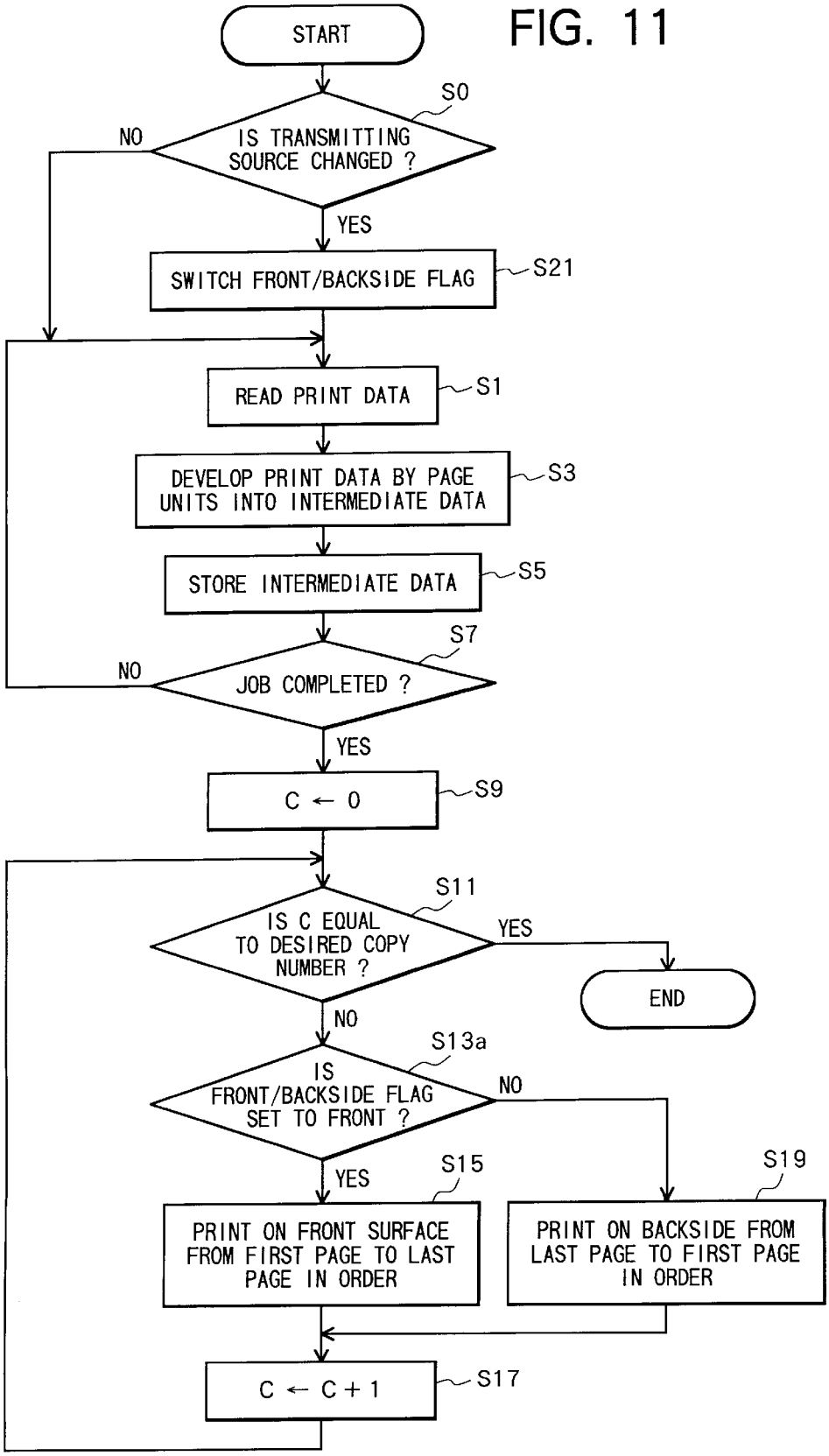
FIG. 11
START
S0
IS TRANSMITTING SOURCE CHANGED ?
NO
YES
SWITCH FRONT/BACKSIDE FLAG
S21
READ PRINT DATA
S1
DEVELOP PRINT DATA BY PAGE UNITS INTO INTERMEDIATE DATA
S3
STORE INTERMEDIATE DATA
S5
S7
JOB COMPLETED ?
NO
YES
C ← 0
S9
S11
IS C EQUAL TO DESIRED COPY NUMBER ?
YES
END
NO
S13a
IS FRONT/BACKSIDE FLAG SET TO FRONT ?
NO
YES
S15
S19
PRINT ON FRONT SURFACE FROM FIRST PAGE TO LAST PAGE IN ORDER
PRINT ON BACKSIDE FROM LAST PAGE TO FIRST PAGE IN ORDER
C ← C + 1
S17

IMAGE FORMING DEVICE

BACKGROUND OF THE INVENTION

1. Field of the Invention

The present invention relates to an image forming device for forming images, based on image data, on a recording sheet, and more particularly to an image forming device for forming images selectively on a front or backside of a recording sheet.

2. Description of Related Art

There has been known a conventional image forming device including a memory for storing image data; an image forming unit, such as a printer engine, for forming images on a front surface of a recording medium based on the image data stored on the memory; and a support unit, such as a discharge tray, for holding a stack of recording sheets formed with images by the image forming unit.

In this type of image forming device, the image forming unit forms an image corresponding to a first page on a first recording sheet, an image corresponding to a second page on a second recording sheet, and so on in order from the first page on. The recording sheets are discharged from the image forming unit one after the other, in the order in which they have been formed with images, and are stacked on the support unit with the image-formed surface facing downward (i.e., face down). When sheets are discharged face down, the printed sheets are automatically stacked in order from the first page on. It is convenient to organize the thus stacked documents.

SUMMARY OF THE INVENTION

However, the following problems arise with this conventional configuration when a plurality of sets of documents (copies) are printed based on a single set of image data. FIG. 1 is a schematic view showing the order in which three sets of three page documents are stacked on the support unit after being formed with images and discharged face down. The numbers one, two, and three indicate the page number of each sheet. In this case, troublesome operations are necessary to separate the three document sets from each other. That is, the user must find the boundary between the first and second document sets and between the second and third document sets by, for example, comparing images formed on the sheets P or by counting the number of sheets P in each set.

Recently, image-forming devices have been provided with large capacity memories. The large capacity memories enable the image-forming devices to form images, which correspond to a plurality of different image data sets, one after another. Further, a print system has been developed wherein a plurality of computers are connected to a single printer via a local area network (LAN) or the like. This print system enables using the same printer to print images, which correspond to image data transmitted from different computers, one after another. These technological advances are very beneficial for increasing the speed of image forming processes. The print system in particular reduces the amount of effort the user must expend in moving between the computer and the printer.

However, when an image-forming device having a large capacity memory or the above-described print system discharges printed sheets face down, the above-described troublesome operations are required to separate recording sheets, that is, according to image data, after images are formed on the recording sheets.

In recent years, duplex image forming devices have been developed which are capable of printing different images on the front and backsides of a recording sheet. Duplex image forming devices can selectively form images on the front and backside surface of a recording sheet. Duplex image-forming device generally discharge sheets so that recording sheets are discharged with the first page image facing downward on the discharge tray. Accordingly, the above-described problems occur as described above.

Further, a sorter including a plurality of support units, such as sheet discharge trays, can be provided to the image forming device. In this case, recording sheets P for different document sets can be stacked on different sheet discharge trays. However, providing such a sorter increases the size and the price of the image-forming device. Also, the number of different document sets that can be separated by the sorter is limited to the number of sheet discharge trays possessed by the sorter.

It is an objective of the present invention to provide an image forming device capable of easily separating printed recording sheets based on certain attributes, such as by document set (copy), by corresponding image data, or by external device from which image data is transmitted, without increasing the size or the cost of the image forming device.

In order to attain the above and other objects, the present invention provides an image forming device, comprising: means for storing image data; means capable of forming images, based on the image data stored in the image data storage means, selectively onto either one of a front surface and a backside surface of one or more image recording medium; means for holding, in a stack, one or more image recording medium formed with the image; and means for controlling the image forming means to form one or more image onto one or more image recording medium while selectively switching a surface of the image recording medium to be formed with the image data, between the front surface and the backside surface, the control means controlling, when one or more image recording medium is to be stacked on the holding means with the first page facing downwardly, the image forming means to successively perform image forming operation with image data for the one or more image recording medium in an order from image data for a first image recording medium and controlling, when one or more image recording medium is to be stacked on the holding means with the first page facing upwardly, the image forming means to successively perform the image forming operation with image data for the one or more image recording medium in a reversed order from image data for a last image recording medium.

The control means may control the image forming means to form a plurality of copies of the same image data onto a plurality of image recording mediums, while switching a surface of one or more image recording medium, to be formed with each copy, between the front surface and the backside surface. According to this control operation, a plurality of copies are discharged alternately in the upwardly-facing state and the downwardly-facing state. When some copy is to be discharged in the downwardly-facing state, the copy is produced through forming images on the image recording medium based on image data in an order from image data for the first image recording medium down to the last image recording medium. When some copy is to be discharged in the upwardly-facing state, on the other hand, the copy is produced through forming images on the image recording medium based on image data in the reversed order from image data for the last image recording medium up to the first image recording medium. The copy document stacked in the downwardly-facing state can be easily separated from the other document copy stacked in the upwardly-facing state because the surfaces, onto which images are printed, of those two document copies are different from each other. It is possible to easily separate the respective copies from one another.

It is unnecessary to use special devices such as sorting devices in order to separate the respective copies from one another. The entire image forming device may not become large in size or highly expensive. According to the present invention, the surfaces, on which images are formed, are switched between the front surface and the backside surface for the respective copies so that the respective copies can be separated from one another. Accordingly, no limit is provided to the number of copies capable of being separated from one another, in comparison with the case where the sorting device is provided.

Especially, when the image recording medium is to be discharged in the downwardly-facing state, images are formed on the image recording medium based on image data in the order from the image data for the first image recording medium to the image data for the last image recording medium. On the other hand, when the image recording medium is to be discharged in the upwardly-facing state, images are formed on the image recording medium based on image data in the reversed order from image data for the last image recording medium to image data for the first image recording medium. Accordingly, in each document copy finally stacked on the holding means, the plurality of pages are arranged from the first page to the last page in order. It is advantageous to organize the documents.

When the plurality of sets of image data are successively stored in the image storage means and are formed on the image recording medium in succession, the control means may preferably operate as described below. The control means may switch the surface of the image recording medium, to be formed with the respective sets of image data, between the front surface and the backside surface. When the image recording medium is to be stacked on the holding means with the first page facing downwardly, images are formed on the image recording medium based on image data in an order from image data for the first image recording medium to image data for the last image recording medium. On the other hand, when the image recording medium is to be stacked on the holding means with the first page facing upwardly, images are formed on the image recording medium based on image data in a reversed order from image data for the last image recording medium to image data for the first image recording medium.

According to the above-described control operation, image recording mediums, formed with the respective sets of image data, are discharged in the downwardly-facing state and the upwardly-facing state in alternation. The image recording mediums, to be discharged in the downwardly-facing state, are formed with images based on image data in order from image data for the first image recording medium to image data for the last image recording medium. The image recording mediums, to be discharged in the upwardly-facing state, are formed with images based on image data in a reversed order from image data for the last image recording medium to image data for the first image recording medium. Each set of image recording mediums stacked in the downwardly-facing state can be easily separated from another set of image recording mediums stacked in the upwardly-facing state because the two stacks are different from each other in their surfaces where images are formed. It is possible to easily separate, from one another, image recording mediums formed with the respective sets of image data.

It is noted that even when using a sorting device, it is impossible to separate, from one another, image recording medium formed with different sets of image data. However, the above-described structure enables the separating operation. There is no limit on the number of the sets of image data capable of being separated from one another.

When it is desirable to form a plurality of copies based on at least one set of image data out of the plurality of sets of image data, the surface of the image recording medium, to be formed with each copy, is switched between the front surface and the backside surface. When the image recording mediums are to be stacked on the holding means with the first page facing downwardly, the image forming means may be controlled to form images on the image recording mediums based on image data in succession from image data for the first image recording medium to image data for the last image recording medium. When the image recording mediums are to be stacked on the holding means with the first page facing upwardly, the image forming means is controlled to form images onto the image recording mediums based on image data in succession from image data for the last image recording medium to image data for the first image recording medium.

In this case, the image recording mediums are discharged in the upwardly-facing state and the downwardly-facing state alternately not only for the respective sets of image data but also for the respective copies for the at least one image data set. Accordingly, the respective copies can be easily separated from one another. In the thus separated copy, the one or more pages are arranged from the first page to the last page. It is therefore possible to easily organize each document copy.

Reception means may be provided to receive a plurality of sets of image data transmitted from a plurality of external devices individually. The plurality of sets of image data thus individually transmitted from the plurality of external sources may be stored in the image storage means in succession. The plurality of sets of image data may be formed on the image recording mediums in succession. In this case, the control means may operate as described below.

The control means may switch, between the front surface and the backside surface, the surface of the image recording medium to be formed with the image data transmitted from the respective external devices. When the image recording mediums are to be stacked on the holding means with the first page facing downwardly, images are formed on the image recording mediums based on image data in succession from image data for the first image recording medium to image data for the last image recording medium. When the image recording mediums are to be stacked on the holding means with the first page facing upwardly, images are formed on the image recording mediums based on image data in succession from image data for the last image recording medium to image data for the first image recording medium.

According to the above-described control, image recording mediums are discharged in the upwardly-facing state and the downwardly-facing state in alternation for the image data transmitted from the respective external devices (data sources). When the image recording mediums are to be discharged in the downwardly-facing state, the image recording mediums are formed with images in succession from images for the first image recording medium to images for the last image recording medium. When the image recording mediums are to be discharged in the upwardly-facing state, the image recording mediums are formed with images in succession from images for the last image recording medium to images for the first image recording medium. The image recording mediums stacked in the downwardly-facing state can be easily separated from the image recording mediums stacked in the upwardly-facing state because the image-formed surfaces in both of the two stacks are different from each other in their image facing directions. It is possible to easily separate, from one another, the image recording mediums formed with image data that has been transmitted from the respective external devices.

It is noted that even when using a sorting device, it is impossible to separate, from one another, image recording medium formed with image data transmitted from different external devices. The above-described structure can, however, easily separate image recording mediums formed with image data transmitted from different external devices. There is also no limit on the number of external devices capable of being separated from one another.

According to another aspect, the present invention provides an image forming device, comprising: means for storing image data; means capable of forming images, based on the image data stored in the image data storage means, selectively onto either one of a front surface and a backside surface of an image recording medium; means for holding, in a stack, one or more image recording medium formed with the image; and means for controlling, when the image storage means stores a plurality of sets of image data in succession, the image forming means to form a plurality of images on a plurality of image recording medium based on the plurality of sets of image data, while performing, for the respective image data sets, at least one of: a first switching operation for switching the surface of the image recording medium between the front surface and the backside surface; and a second switching operation for switching an orientation of the image to be formed on the image recording medium between a first orientation and a second orientation, the control means controlling the image forming means to form a plurality of copies onto a plurality of image recording medium based on at least one set of image data, while performing, for the respective copies, at least one of the first switching operation and the second switching operation.

According to this structure, at least one of the surface of the image recording medium and the orientation of image is alternated for the respective sets of image data. When the plurality of copies are to be formed based on some image data, at least one of the surface and the orientation of the image recording medium is alternated for the respective copies. It is possible to separate, from one another, image recording medium both for the respective image data sets and for the respective copies for some image data set. Because no special device such as a sorter is required, the entire image forming device will not be made large or expensive. There is no limit to the number of copies and image data sets capable of being separated.

The order, in which images are formed on the image recording medium, can be freely set. For example, when the image recording mediums are to be stacked with the first page facing upwardly, that is, when the image recording mediums are to be discharged with the upwardly-facing state, images may be formed on the image recording mediums in succession from an image for the first image recording medium to another image for the last image recording medium.

When at least the surface of the image recording medium is switched between the front surface and the backside surface for the respective sets of image data, if the orientation of the image is switched between the first and second orientations for the respective copies, the following striking effects can be obtained.

Separating image recording mediums formed with the respective sets of image data and separating image recording mediums formed with the respective copies are based on different aspects, such as the image forming surface and the image forming orientation. A user can therefore easily separate image recording mediums according to the respective sets of image data irrespective of the number of copies obtained. When a plurality of documents are formed according to the plurality of sets of image data in succession and when a plurality of copies are formed according to at least one set of image data out of the plurality of image data, naturally, the image recording mediums formed with different image data sets will be first separated from one another. Then, each copy will be separated from one another out of one separated group. Thus, it is possible to easily separate image recording mediums according to the respective sets of image data irrespective of the number of copies. It is also possible to easily separate the image recording mediums according to the respective copies. It is advantageous to organize respective documents.

It is noted that orientation of images can be switched in various manners. For example, orientation of images may be switched for each copy. Or, orientation of images can be switched for every set of print data, while switching whether the images are printed on the front side or the backside of recording sheets is performed according to each copy. Or, switching whether the images are printed on the front side or the backside of recording sheets may be performed according to both each copy and each set of print data. Only image orientation may be switched for every image data set and for every copy. In addition, printing may be successively executed from the first image recording medium in order even when the printing is performed onto the backside surface so that the printed sheets will be stacked on the holding means with the printed surfaces facing upwardly. Similarly, printing may be successively executed from the last recording medium in order even when the printing is performed onto the front side surface so that the printed sheets will be stacked on the holding means with the printed surfaces facing downwardly. Even in those cases, the printed recording mediums can be easily separated by every print data set and by every copy.

According to still another aspect, the present invention provides an image forming device, comprising: image forming means capable of forming an image onto a sheet; sheet discharging means capable of discharging the image-formed sheet; and control means for controlling a discharging state of the image-formed sheet.

BRIEF DESCRIPTION OF THE DRAWINGS

The above and other objects, features and advantages of the invention will become more apparent from reading the following description of the preferred embodiment taken in connection with the accompanying drawings in which:

FIG. 11 is a flowchart representing still another variation of the control processes of FIG. 5;

DETAILED DESCRIPTION OF THE PREFERRED EMBODIMENTS

Figure 1:
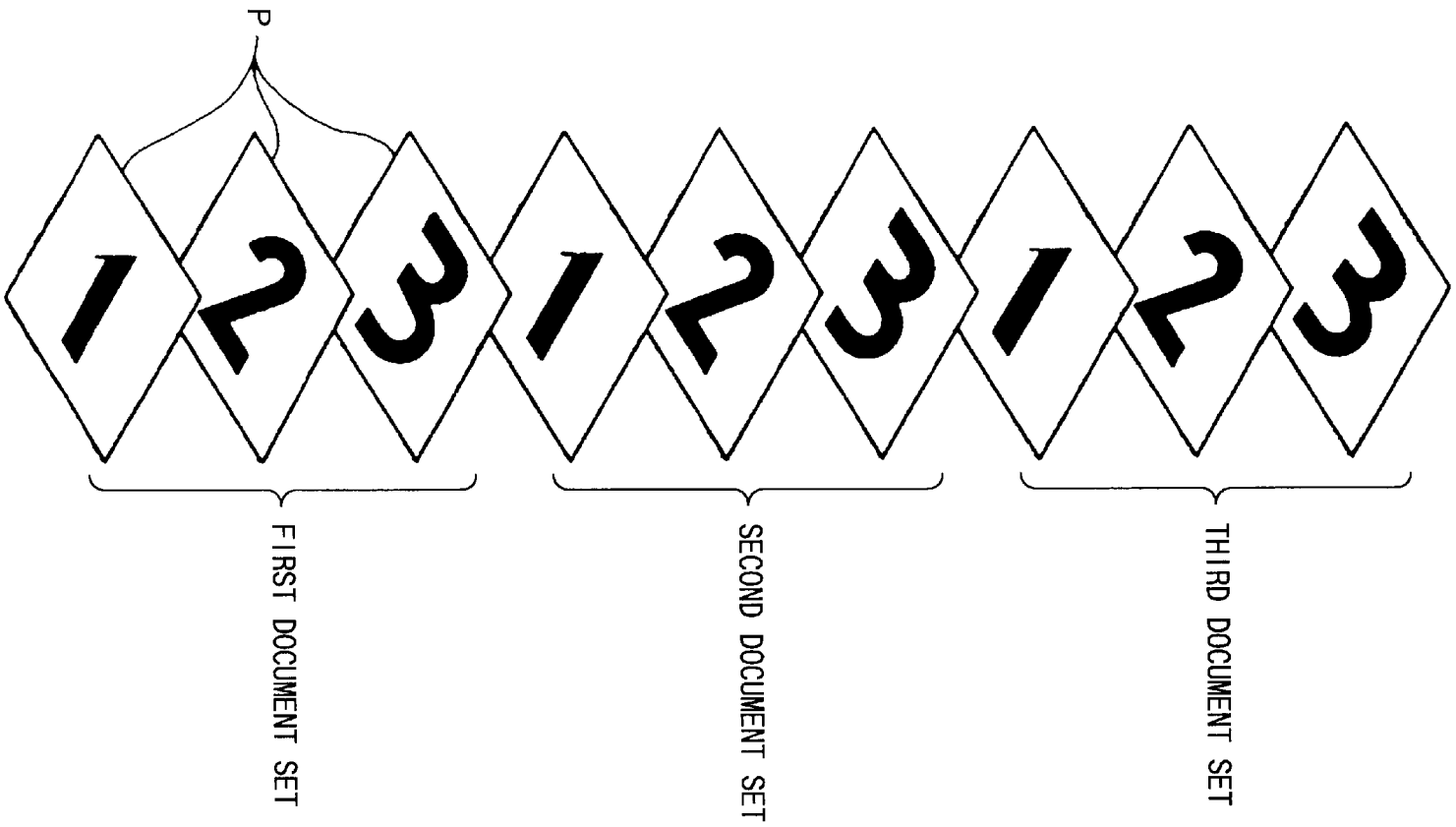
FIG. 1 RELATED ART
FIG. 1 is a schematic view showing order and orientation of three sets of a three page document printed by and discharged face down from an image forming device.

An image forming device according to a preferred embodiment of the present invention will be described while referring to the accompanying drawings wherein like parts and components are designated by the same reference numerals to avoid duplicating description.

Figure 2:
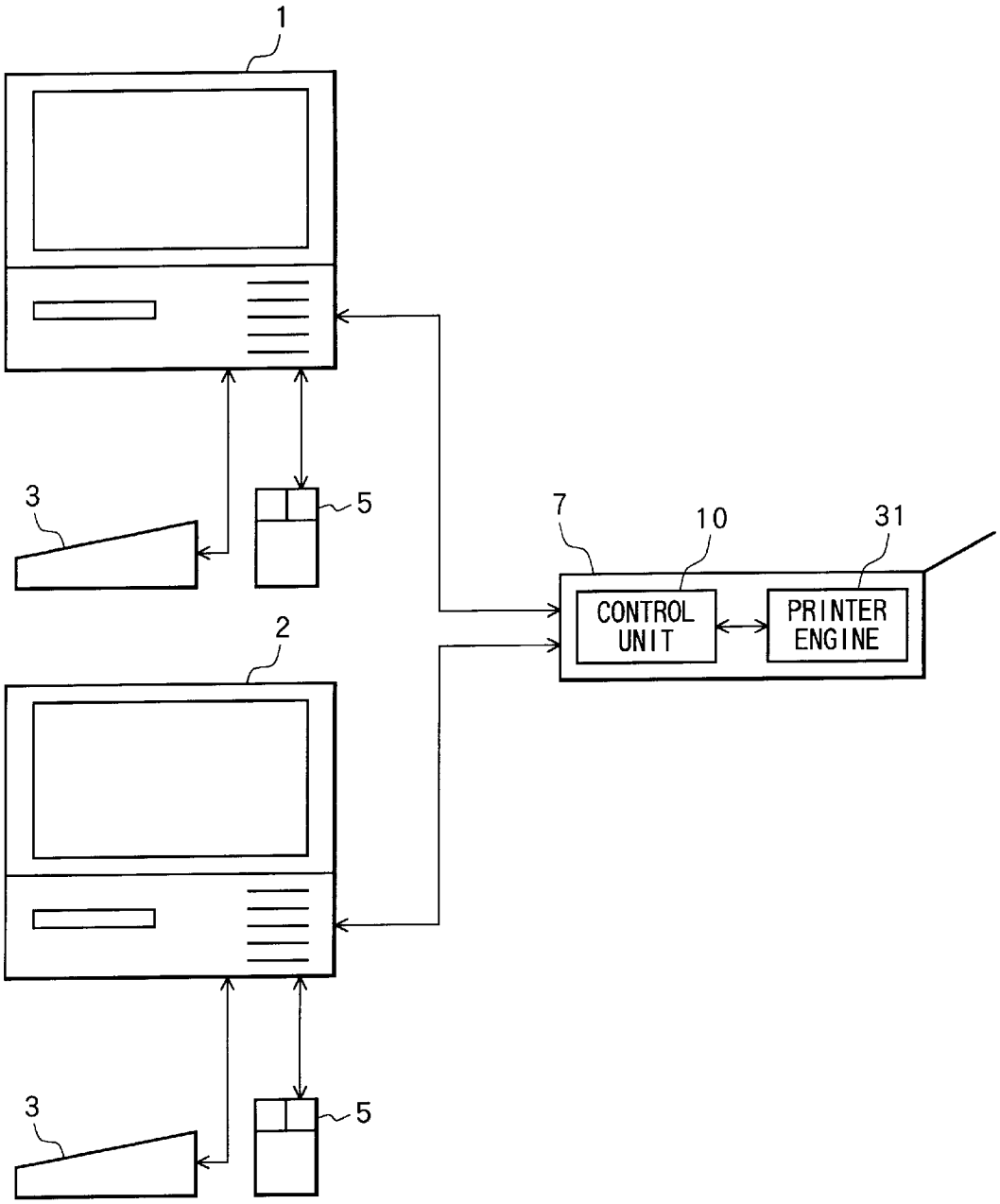
FIG. 2 is a schematic view showing overall configuration of a printer system according to an embodiment of the present invention.

FIG. 2 is a schematic view showing overall configuration of a printer system including a plurality of host computers 1 and 2 and a single printer 7, which serves as an image forming device according to the present invention. Although not shown in the drawings, each host computer 1, 2 includes a central process unit (CPU), a read-only memory (ROM), and a random-access memory (RAM). Each host computer 1, 2 is connected to a separate keyboard 3 and a mouse 5.

The host computers 1 and 2 are connected to the printer 7 by a local area network (LAN) and so are separated from the printer 7 by a fair distance. Although not shown in the drawings, a server device is provided within the local area network for enabling the host computers 1 and 2 to both commonly use the same single printer 7. The printer 7 includes a control unit 10 and a laser printer engine 31.

With the printer system configured in this manner, the user uses the keyboard 3 or/and mouse 5 of his or her host computer 1 or 2 to prepare image data. The user then controls his or her host computer 1, 2 to transmit the image data as print data to the printer 7 so that the printer 7 print images based on the print data. It should be noted that more than two host computers can be provided. However, the present embodiment will be described using only two representative host computers 1 and 2.

In this example, the LAN is a large scale LAN that includes the special server device (server computer, not shown) having a printer server function and other functions. However, the LAN can be configured in any manner. For example, the LAN can be a comparatively small scale LAN, such as a peer-to-peer type LAN, which enables a user to use the printer 7 connected to one of the host computers 1, 2 from the other of the host computers 1, 2.

The configuration of the printer 7 will be described below in greater detail.

The control unit 10, such as a microcomputer, is provided internally to the printer 7, and is connected to both of the host computers 1 and 2 via the LAN. In the printer 7, the control unit 10 is connected to the laser printer engine 31.

Figure 3:
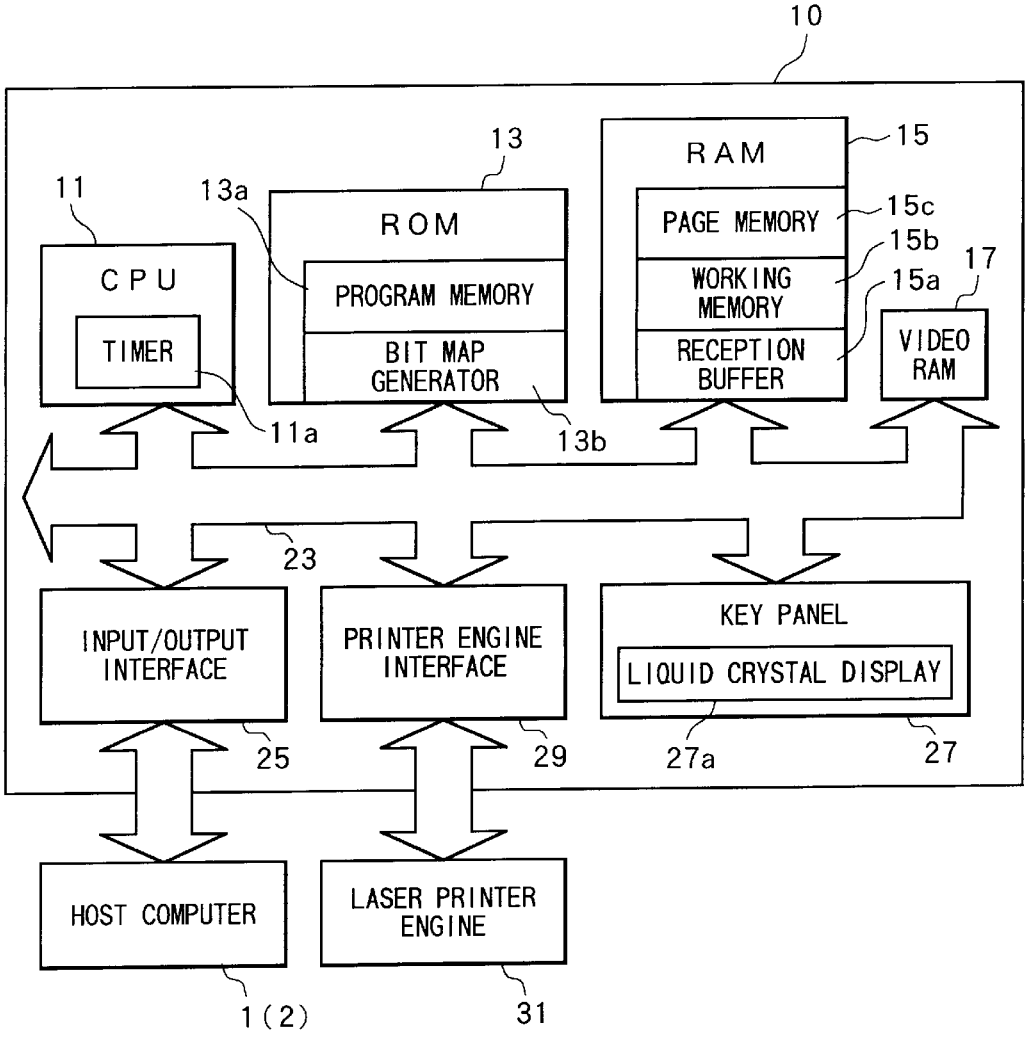
FIG. 3 is a block diagram showing connection of electrical components of a laser printer in the system shown in FIG. 2.

FIG. 3 is a block diagram schematically showing connection of components in the printer system of FIG. 1.

As shown in FIG. 3, the control unit 10 includes a CPU 11, a ROM 13, and a RAM 15, an input/output interface 25, a printer engine interface 29, a key panel 27, and a video RAM 17, all mutually connected through a bus 23. Data is therefore transmitted between the respective components. The CPU 11, the ROM 13, and the RAM 15 make up essential portions of the microcomputer.

The CPU 11 is for controlling overall operations of the printer 7 and includes a timer 11*a*, which uses a clock signal. The ROM 13 includes a program memory 13*a* and a bit map generator 13*b*. The program memory 13*a* stores a variety of programs to be described later. The bit map generator 13*b* is for developing intermediate data, that is, page data, into video data having a bit map configuration. The video RAM 17 is for temporarily storing the video data.

The intermediate data is stored in a page memory 15*c* to be described later. A first example of intermediate data is data formed by compressing bit map data using well-known methods, for example by runlength compressing each scan line of bit map data into runlength data or by compressing block units of bit map data into block data, wherein each block unit consists of a predetermined number of image pixels. A second example of intermediate data is data formed from a combination of pointer data and position data, wherein the pointer data indicates the storage position for a variety of figure data and character data (dot data) prestored in the device, and the position data indicates position where the figure data or character data should be outputted on the print medium.

When the printer is of a type that does not store font data or other character data, the host computer is provided with a printer driver of a type that operates to form print data by compressing bit map data as described above for the first example of intermediate data and to transmit the print data to the printer. On the other hand, when the printer stores font data or other character data, usually the host computer transmits print data to the printer in the form of character codes and control codes, and the printer performs processes, based on the codes from the host computer, to convert data into the intermediate data described in the second example above.

In either example, intermediate data is in a form appropriate for a print mechanism, such as the laser printer engine 31, to print images to be printed. That is, the intermediate data is in the form that can be developed into print output data such as video data within a predetermined period of time and that can reduce as much as possible the memory capacity required to store the data for printing images.

The RAM 15 includes a reception buffer memory 15*a*, a work memory 15*b*, and the page memory 15*c*. The reception buffer memory 15*a* is for temporarily storing print data received from an external source. The work memory 15*b* is for storing a variety of flags and the like used when executing various programs. The page memory 15*c* is for storing intermediate data, which has been converted from each received page's worth of print data, together with position data indicative of the final position, onto which corresponding images are to be printed on a recording medium, such as a recording sheet P shown in FIG. 4.

It is noted, however, that the intermediate data stored in the page memory 15*c* need not have been converted by the printer 7 into intermediate data. For example, the printer 7 can receive print data of a type that has been predeveloped into intermediate codes by a print driver that operates in either of the host computers 1, 2 as described above. In this case, the print data will serve as intermediate data. When such print data is received from the host computer 1 or 2, the print data is stored directly into the page memory 15*c* via the reception buffer memory 15*a*.

The input/output interface 25 is for performing reception of print data from the host computer 1 or 2. The key panel 27 enables the user to perform a variety of input operations. The key panel 27 is provided with a display 27*a* for displaying operating condition of the printer 7. Although not shown in the drawings, the key panel 27 also includes keys relating to normal printing and for setting a variety of modes. The printer engine interface 29 includes an internal drive circuit (not shown) for performing transmission with the laser printer engine 31.

Figure 4:
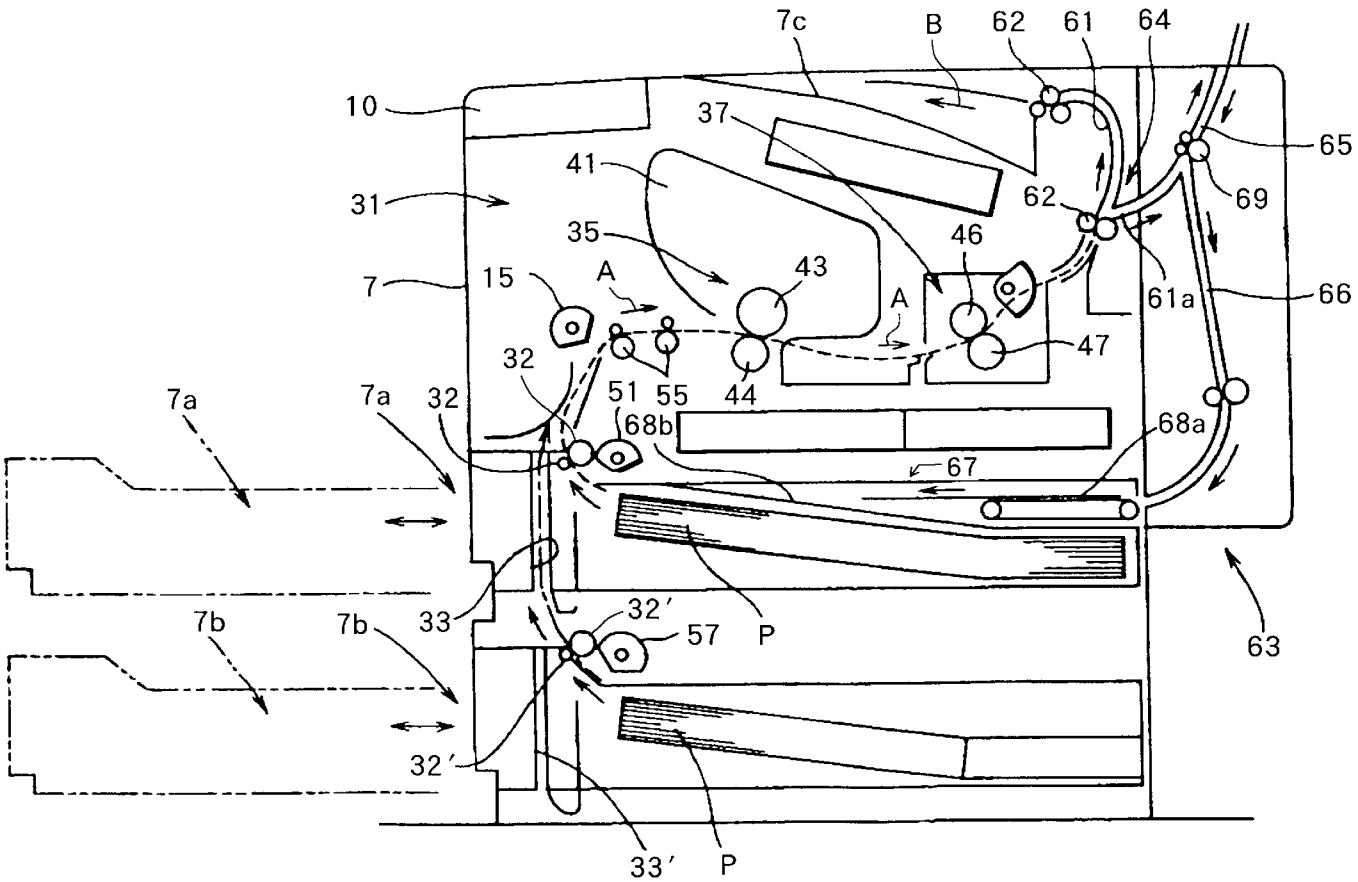
FIG. 4 is a cross-sectional view showing a laser printer of the system shown in FIG. 2.

Next, configuration of the laser printer engine 31 in the printer 7 will be described while referring to FIG. 4. FIG. 4 is a cross-sectional view showing configuration of the printer 7. The printer 7 is a laser printer for forming toner images on recording sheets P.

As shown in FIG. 4, the printer 7 includes first and second sheet feed cassettes 7*a*, 7*b* each for holding a stack of recording sheets P on which toner images are to be formed. Both of the first and second sheet feed cassettes 7*a*, 7*b* are configured in substantially the same shape. That is, the first sheet feed cassette 7*a* is formed at its front end (leftside end in the figure) with an elongated slot 33, and the sheet feed cassette 7*b* is formed with an elongated slot 33'. Both the elongated slot 33, 33' extend perpendicular to the surface of FIG. 4 and penetrate through the corresponding one of the first and second sheet feed cassettes 7*a*, 7*b* in the vertical direction. Also, a pair of sheet feed rollers 32 are disposed at the front end of the first sheet feed cassette 7*a*, and a pair of sheet feed rollers 32' are disposed at the front end of the second sheet feed cassette 7*b*. Both of the pairs of sheet feed rollers 32, 32' extend parallel with the elongated slots 33, 33'.

A pick up roller 51 is disposed in the first sheet feed cassette 7*a* adjacent to the sheet feed rollers 32 and in confrontation with the front edge of an uppermost recording sheet P in the stack of sheets in the first sheet feed cassette 7*a*. The pick up roller 51 is disposed around the periphery of a rotational axis. As shown in FIG. 4, the pick up roller 51 is formed in a semi-circular shape in cross section having a large diameter in a predetermined angular portion and having a small diameter in a remaining angular portion. With this configuration, only the predetermined angular portion with the large diameter will abut against the uppermost recording sheet P so that when the pick up roller 51 rotates, one recording sheet P at a time will be fed out of the first sheet feed cassette 7*a* to the sheet feed rollers 32.

A pick up roller 57 having a form similar to the pick up roller 51 is disposed in the second sheet feed cassette 7*b* adjacent to the sheet feed rollers 32'. Rotation of the pick up roller 57 feeds a recording sheet P to the sheet feed rollers 32'. The sheet feed rollers 32' transport each recording sheet P fed out by the pick up roller 57 upward through the elongated slot 33.

A discharge tray 7*c* is provided at the upper surface of the printer 7. The discharge tray 7*c* is for holding a stack of printed-on recording sheets P.

Here, an explanation will be provided for components disposed along a sheet transport pathway traveled by recording sheets P transported from the first and second sheet feed cassettes 7*a*, 7*b* to the discharge tray 7*c*. A plurality of feed rollers 55 are disposed downstream from the sheet feed rollers 32 along the sheet transport pathway. The laser printer engine 31 is disposed downstream from the feed rollers 55. The feed rollers 55 pick up and transport recording sheets fed out from the first sheet feed cassette 7*a* toward the laser printer engine 31. The feed rollers 55 also pick up and transport, toward the laser printer engine 31, recording sheets that have been fed out from the second sheet feed cassette 7*b* and that have passed through the elongated slot 33 of the first sheet feed cassette 7*a*.

The laser printer engine 31 includes an image forming unit 35 and a fixing portion 37. The image forming unit 35 includes: a photosensitive drum 43 disposed within a toner cartridge 41; a transfer roller 44 disposed in abutment contact with the photosensitive drum 43; and a laser light emitting portion (not shown) for irradiating the photosensitive drum 43 with a laser beam modulated based on print data. The fixing portion 37 is disposed along the sheet transport pathway at a position downstream from the image forming unit 35 in a direction A, in which recording sheets P are transported. The fixing portion 37 includes a thermal roller 46 and a pressing roller 47, which are disposed in mutual pressing abutment contact with each other.

Recording sheets P are transported by the feed rollers 55 to a position between the photosensitive drum 43 and the transfer roller 44, whereupon the photosensitive drum 43 and the transfer roller 44 transport the recording sheets P to the thermal roller 46 and the pressing roller 47.

A discharge transport pathway 61 is formed downstream of the pressing roller 47 and the thermal roller 46 for guiding recording sheets P from the pressing roller 47 and the thermal roller 46 to the discharge tray 7*c*. One pair of feed rollers 62 are disposed at the inlet of the discharge transport pathway 61. Another pair of feed rollers 62 are disposed at the outlet of the discharge transport pathway 61 for discharging the recorded sheets P in a discharging direction B.

A divider portion 64 is formed in the discharge transport pathway 61. A transport pathway 61*a* divides off from the discharge transport pathway 61 at the divider portion 64. Although not shown in the drawings, a well-known rotational type guide is provided in the divider portion 64. An electromagnetic solenoid (not shown) is provided to swing the rotational type guide so that the guide will direct recording sheets either to the discharge transport pathway 61 or to the other transport pathway 61*a*.

An inversion unit 63 for turning the recording sheets P over is provided at the rear side of the printer 7, that is, at the right side of the printer 7 as viewed in FIG. 4. Recording sheet P can be transported to the inversion unit 63 via the transport pathway 61*a*.

The inversion unit 63 is formed with a first inversion transport pathway 65 and a second inversion transport pathway 66. The lower end of the first inversion transport pathway 65 is in communication with the transport pathway 61*a*, and the upper end of the first inversion transport pathway 65 is opened up at the upper surface of the inversion unit 63. The second inversion transport pathway 66 divides off from the middle portion of the first inversion transport pathway 65. That is, the upper end of the second inversion transport pathway 66 is in communication with a middle portion of the first inversion transport pathway 65 and the lower end extends to a lower left edge of the inversion unit 63.

A pair of switching rollers 69 are disposed at the position where the second inversion transport pathway 66 divides off from the first inversion transport pathway 65. The switching rollers 69 are freely rotatable in both forward and reverse directions.

A transport unit 67 is disposed at a position above a sheet storage containing portion of the first sheet feed cassette 7*a* and in communication with the lower end of the second inversion transport pathway 66. The transport unit 67 includes: a belt 68*a* extending from adjacent to the lower end of the second inversion transport pathway 66; and a slanted surface 68*b* extending from the belt 68*a* in a direction toward the supply rollers 32. The belt 68*a* serves to feed recording sheets P, exiting from the second inversion transport pathway 66, to the sheet feed rollers 32 along the slanted surface 68*b*.

With the above-described structure, the printer 7 can perform duplex printing operation as described below.

In order to print on both sides of a recording sheet P, the recording sheet P is first fed out from one of the first and second sheet feed cassettes 7*a*, 7*b* and transported to the image forming unit 35, where one side of the recording sheet P is printed with an image. Then, the recording sheet P is transported through the fixing portion 37 to the divider portion 64.

During the duplex printing mode, the electromagnetic solenoid is first operated to swing the rotational type guide to direct the recording sheet P to the transport pathway 61*a*. The rotation of the switching rollers 69 is controlled to feed the recording sheet up into the first inversion transport pathway 65. Then, rotational direction of the switching rollers 69 is reversed so that the recording sheet P is transported into the second inversion transport pathway 66. When the recording sheet P reaches the lower end of the second inversion transport pathway 66, it is picked up by the belt 68*a* and transported to the sheet feed rollers 32 along the slanted surface 68*b*. The recording sheet P is then transported a second time to the image forming unit 35, where the other side of the recording sheet P is printed with an image. In this way, the recording sheet P is printed with images on both sides. Then, the electromagnetic solenoid is operated to swing the rotational type guide to direct the recording sheet P to the discharge transport pathway 61, thereby discharging the recording sheet P onto the discharge tray 7*c*.

Figure 5:
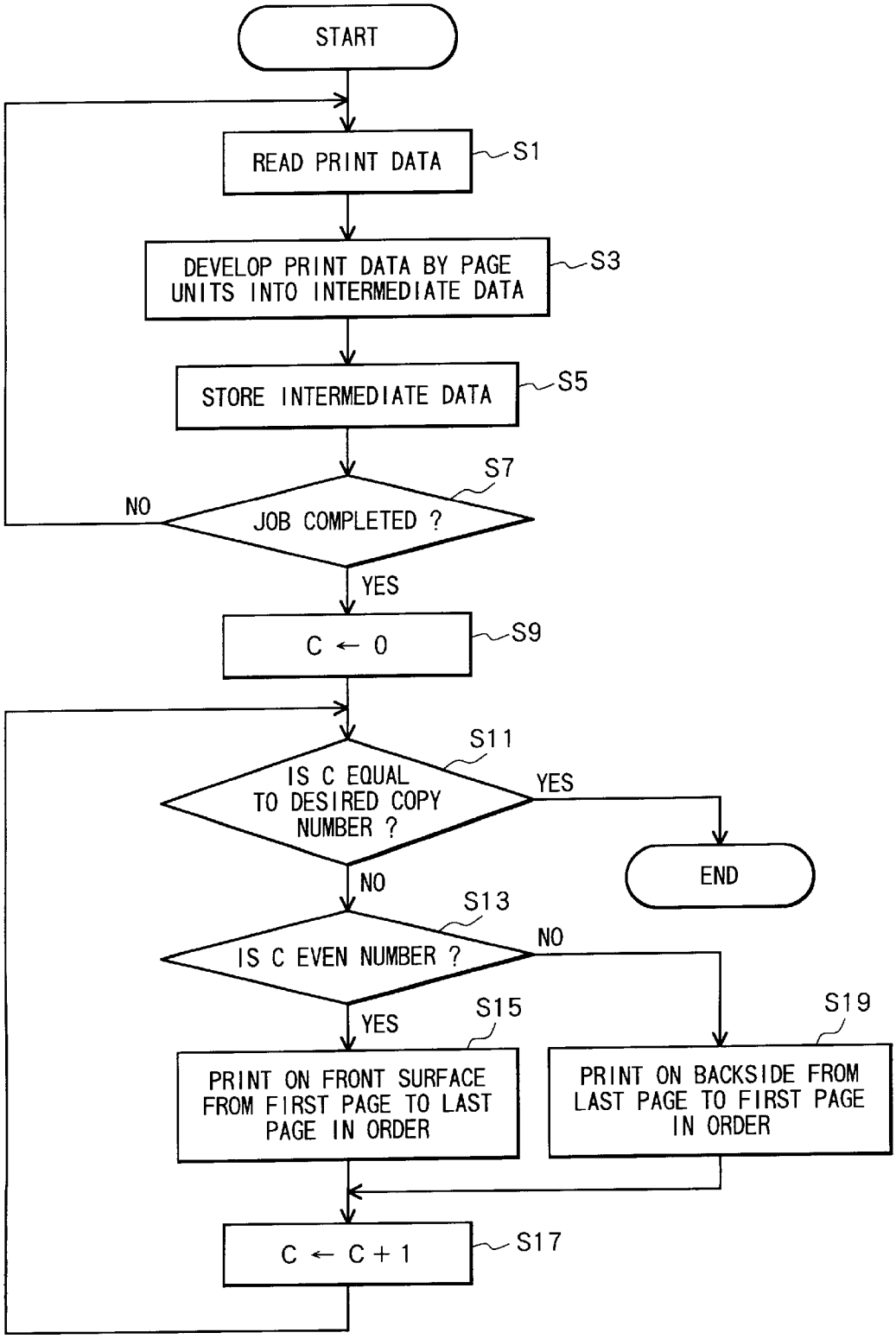
FIG. 5 is a flowchart representing control processes of the control system shown in FIG. 3.

Next, processes for controlling the laser printer engine 31 will be described while referring to the flowchart of FIG. 5. The laser printer engine 31 is controlled by drive signals outputted from the control unit 10 based on print data transmitted from either of the host computers 1 or 2. FIG. 5 is a flowchart representing control processes executed by the control unit 10 to control the laser printer engine 31. In the following explanation, S refers to a particular step.

The control unit 10 starts the processes of FIG. 5 when it receives, from either one of the host computers 1, 2, print data for a subject document to be printed.

As shown in FIG. 5, when these processes are started, first the print data from the host computer 1 or 2 is read in S1. Next in S3, the print data is developed by page units into intermediate data. Afterward in S5, the intermediate data is stored in the page memory 15*c* of the RAM 15. Next in S7, it is determined whether or not the present job has been completed, that is, whether or not data processes relating to the subject document have been completed. When some data relating to the subject document remains unprocessed (S7:No), then S1 to S5 are repeated. On the other hand, after the processes of S1 to S5 have been performed for all data relating to the subject document (S7:YES), then the program proceeds to S9 and subsequent steps in order to actually print images of the document on one or more recording sheets P, depending on the number of pages forming the document.

To perform actual printing operations, first in S9, a copy number counter C, which indicates the number of document copies that have actually been printed, is reset to zero, because at this point no copies of the document have been printed yet. Then in S11, it is determined whether or not the value of the copy number counter C is equal to the number of copies desired by the user to be printed out. This desired copy number has been set by the user at the host computer, and information of this number is transmitted together with the print data to the printer 7. It is noted that the desired copy number may be a copy number initially set in the printer 7. The first time S11 is reached after the processes of FIG. 5 are started, the copy number counter C will just have been reset to zero in S9, so that S11 will automatically result in negative determination. As a result, the program proceeds to S13, where it is determined whether or not the value of the copy number counter C is an even number. The first time S13 is reached after the processes of FIG. 5 are started, the value of the copy number counter C will be zero, so that S13 results in a positive determination ("yes" in S13). As a result, the program proceeds to S15. In S15, the first copy of the document is printed based on the print data from the host computer 1 or 2. It should be noted that if the document includes more than one page, in S15 the first page is printed first. Subsequent pages are then printed also in the same step of S15 in sequence up to the last page.

It is noted that in S15, printing is performed on the "front surface" of the recording sheets P. Here, "front surface" refers to the surface of the recording sheet P that will face downward on the discharge tray 7*c* after printing processes are completed, that is, regardless of how the recording sheet P has been oriented in the first and second sheet feed cassettes 7*a*, 7*b*. In other words, in S15 recording sheets P are printed with images of the first page on, in sequence, and discharged one after the other face down onto the discharge tray 7*c*, with the first page on the bottom of the stack.

During S15, the CPU 11 performs well-known printing process for retrieving intermediate data stored in the page memory 15*c*, developing the intermediate data into video data, and driving the image forming unit 35 and the like to print images on the front surface of a recording sheet P. The CPU 11 first performs this printing process for the first page, and then performs the printing processes for subsequent pages, if any, in an order down to the last page.

Each recording sheet P is transported past the image forming unit 35 and the fixing portion 37 only once. Each printed recording sheet P is discharged onto the discharge tray 7*c* via the discharge transport pathway 61 after only one surface of each recording sheet P is printed on. After the printing processes of S15 have been performed, one copy of the subject document will be stacked on the discharge tray 7*c* with the first page on the bottom and subsequent pages, if any, stacked on the first page in order, with the printed surface of all sheets facing downward.

After the printing processes of S15 are completed, the program proceeds to S17, where the value of the copy number counter C is incremented by one. Then the program returns to S11. When the value of the copy number counter C has still not reached the required number of copies (S11:No), then the program will proceed to S13. At this time in the present example, the value of the copy number counter C will be one. If more than one copy of the subject document are to be printed (S11:NO), then the program proceed to S13.

Further, because the value of the copy number counter C is one at this time, S13 will also result in a negative determination ("no" in S13) so that the program proceeds to S19. In S19, the second copy of the document is printed from the last page to the first page, assuming that the subject document includes more than one page, in this order on the backside of the recording sheets P. Each printed recording sheet P will be discharged in this order face up on the discharge tray 7*c*. Then the program proceeds to S17.

During S19, the CPU 11 performs well-known printing processes for retrieving intermediate data stored in the page memory 15*c*, developing the intermediate data into video data, and driving the image forming unit 35 and the like to print the last to first pages in this order. Each recording sheet P is transported past the image forming unit 35 and the fixing portion 37 a first time to form an image on one surface of the recording sheet P. Then the sheet P is transported to the inversion unit 63, where it is turned over. Afterward each recording sheet P is transported through the transport unit 67 to the image forming unit 35 and the fixing portion 37. However, the second time each recording sheet P is transported past the image forming unit 35 and the fixing portion 37, the image forming unit 35 and the fixing portion 37 will not be operated so that no further images will be formed on the recording sheet P. As a result, the sheets will be printed on only one side and discharged face up onto the discharge tray 7*c*. After the printing processes of S19 are completed, the second copy of the subject document will be stacked on top of the first copy of the document on the discharge tray 7*c*. The first page of the second copy will be on top of the stack, with any subsequent pages of the second copy disposed beneath the first page in sequence to the last page. Also, although pages of the first copy will face downward, the pages of the second copy will face upward.

Also during the printing processes performed in S19, the CPU 11 processes data so that images will be printed on the recording sheets P with an inverted orientation, that is, with top and bottom inverted. "Top" and "bottom" of a page correspond to the upper and lower portions, respectively, of an image formed on a single surface of a sheet using normal printing operations with respect to the sheet feeding direction A, and should not be confused with the "front" and "backside" of a recording sheet. The orientation of images can be inverted by rotating the print format by 180 degrees using well-known processes for reversing order at which data is retrieved from the video RAM 17. It should be noted that any printer capable of duplex printing will naturally have a function for rotating images 180 degrees before printing the images. Such a function is necessary because if an image is printed on the backside of a recording sheet P without first rotating the image 180 degrees, the image will appear upside down compared to the image on the front side.

The image forming unit 35 will print images on the recording sheets P in S19 with the top and bottom orientation inverted compared to images printed in S15. However, in S19, the inversion unit 63 also inverts the recording sheets P themselves, so that the images printed on recording sheets P in both processes of S15 and S19 will all have the same orientation with respect to the discharging direction B when the recording sheets P are discharged onto the discharge tray 7*c*. That is, the top of each page printed on recording sheets P in both S15 and S19 will be disposed at the forward edge of the recording sheets P with respect to the discharge direction B. After the printing processes in S19 are completed, settings that determine retrieval order of image data and the like for inverting images to be printed are returned to the original states.

The printing processes of S15 and S19 are executed in alternation, that is, first S15, then S19, then S15 again, until the required number of document copies is printed out. As a result of the incrementing process of S17, the value of the copy number counter C will match the required number of copies at this time (S11:YES), so that the processes of FIG. 5 are stopped.

Here, an example of printing performed based on the processes of FIG. 5 will be described while referring to FIGS. 6, 7, and 8. In this example, three copies of a three page document will be printed.

Figure 6:
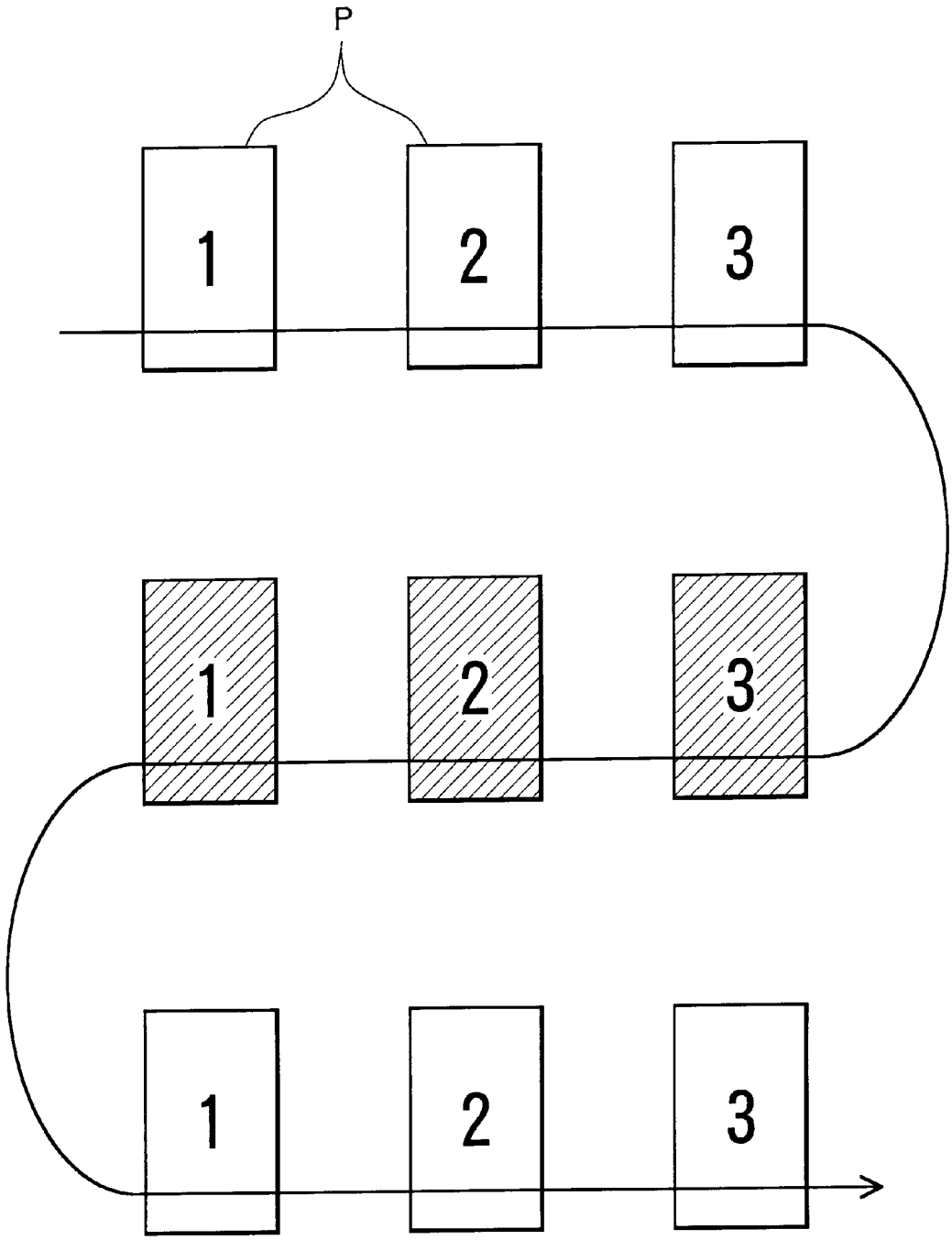
FIG. 6 is a schematic view showing how sheets appear when printed on by the laser printer of FIG. 4 when controlled using the control processes of FIG. 5.
Figure 7:
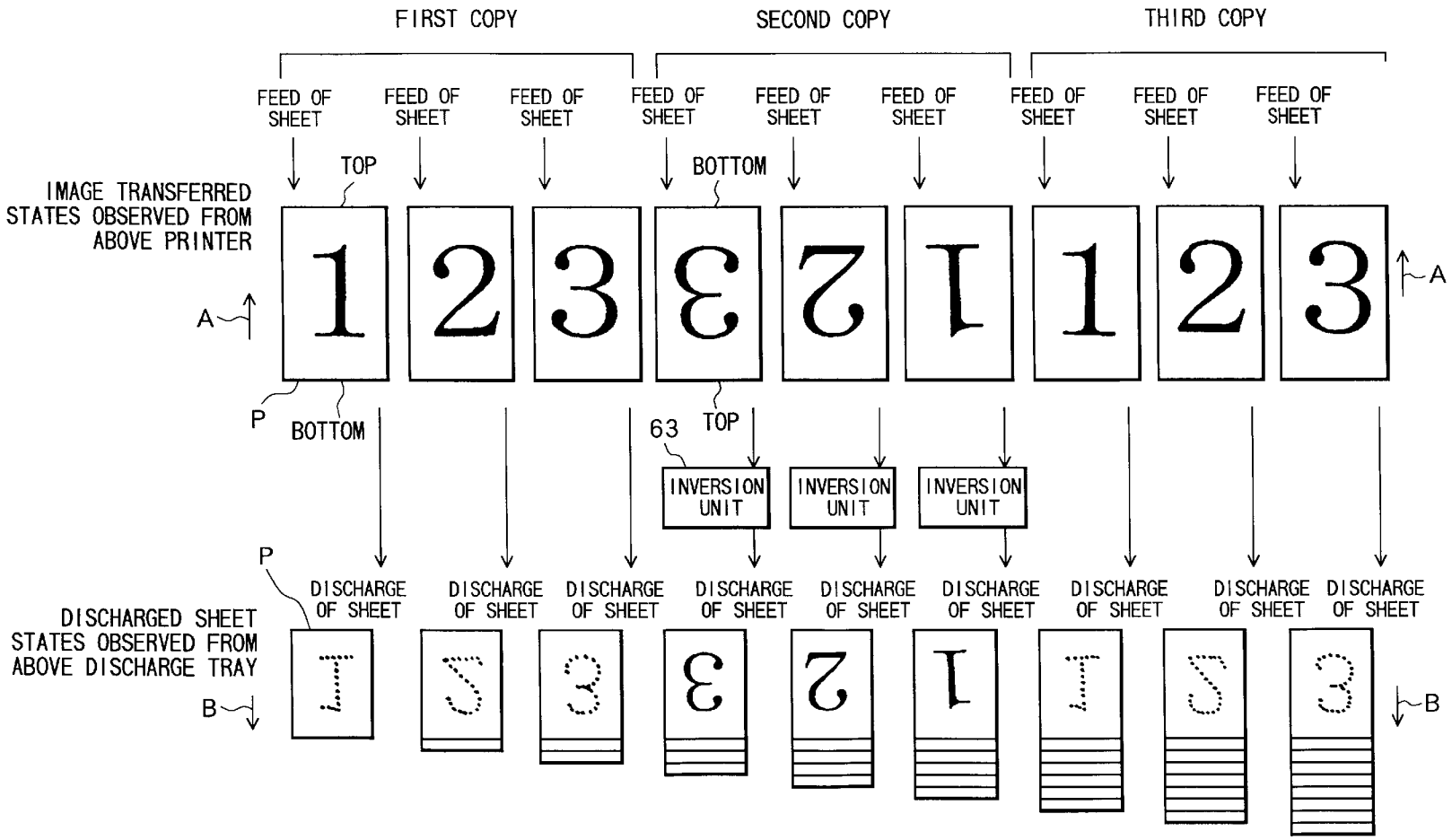
FIG. 7 is a schematic view showing how recording sheets are printed, transported, discharged, and stacked in the manner shown in FIG. 6.

Because the value of the copy number counter C will be zero at first (S13:Yes), then according to the printing processes of S15, the first page, the second page, and the third page are printed in this order on the front surface of three separate recording sheets P as shown in FIG. 6. During S15, the image orientation inversion process (print format rotation process) is not executed as shown in FIG. 7. Accordingly, each page is recorded on a recording sheet P so that the top of each page image is disposed at the forward edge of the recording sheet P in the sheet feeding direction A.

Next, in S17, the copy number counter C is incremented to a value of one, that is, an odd number, so that S13 results in a negative determination. The program then proceeds to S19, whereupon pages three, two, and one are printed in this order on the backside of three other recording sheets P. It should be noted that in FIG. 6, the backside of recording sheets P is indicated by hatching. More specifically, during S19, the image orientation inversion process (print format rotation process) is executed onto each page image so that the "top" and "bottom" orientation of each page image is inverted as shown in FIG. 7. The inverted image is printed on a corresponding sheet. Accordingly, each page is recorded on a recording sheet P so that the top of each page image is disposed at the rear edge of the recording sheet P in the sheet feeding direction A. Then, each recording sheet P is turned over by the inversion unit 63 before being discharged onto the discharge tray 7*c*.

Afterward, the value in the copy number counter C is again incremented in S17 by one to a value of two, that is, an even number, so that S13 results in a positive determination. The program then again proceeds to S15, whereupon the first, second, and third pages are printed in this order on the front side of different recording sheets P.

Then, the value in the copy number counter C is incremented in S17 to three. As a result, the process of S11 results in a positive determination and the process of FIG. 5 are ended.

Figure 8:
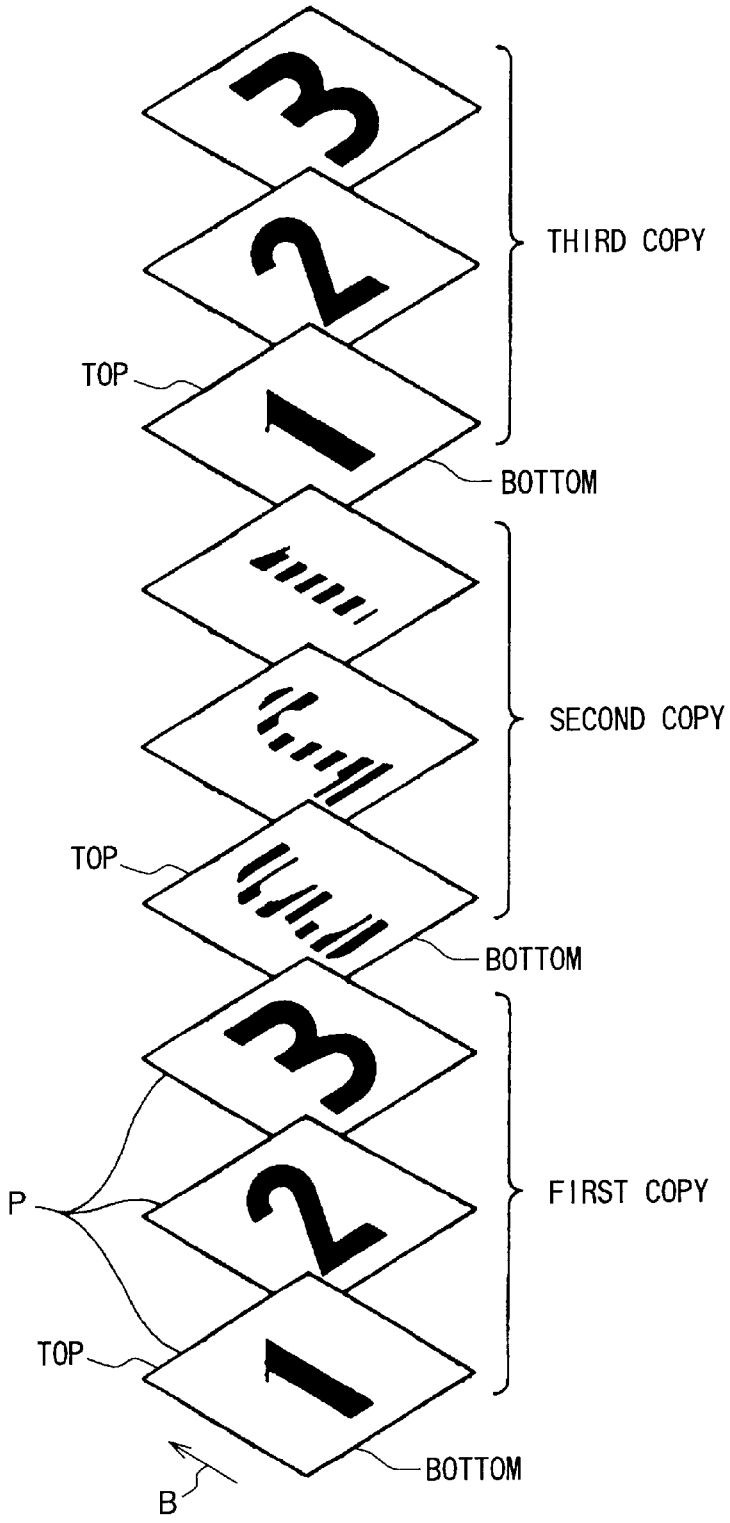
FIG. 8 is a schematic view showing stacked condition of sheets printed in a manner shown in FIGS. 6 and 7 after being discharged from the laser printer of FIG. 4.

After the above-described processes of FIG. 5 are ended, the three copies of the three-page document are stacked on the discharge tray 7*c* as shown in FIG. 8. As shown, the first and third document copies, which are odd numbered copies, are oriented face down on the discharge tray 7*c* and the second document copy, which is an even numbered document set, is oriented face up on the discharge tray 7*c*. Successive document copies are printed with images on front and back sides in alternation. Said differently, pages of every other document copy are printed with images on the same side. Further, regardless of how many document copies are printed, individual pages of the document copies will be in order of first page, second page, and third page. That is, the images are disposed in the increasing order of pages. In addition, as shown in FIG. 8, the images printed on all the document copies have the same orientation along the discharging direction B on the discharge tray 7*c*. That is, the top of each page image printed on all the document copies are disposed at the forward edge of the recording sheet P with respect to the discharge direction B.

As described above, the printer 7 can print and discharge sheets to face down in S15 and to face up in S19 alternately for each successive document copy. For this reason, the user can easily separate different copies of the same document based on whether the images are printed on the front side or the backside of the print sheets. Furthermore, pages are arranged in increasing order in the documents from first page to last page, so that documents are easy to organize.

Because there is no need to provide a special device, such as a sorter, to separate documents, the printer 7 can be made inexpensively and in a compact shape. Because successive document copies are distinguishable by whether images are printed on the front or back side of recording sheets, there is no limit to the number of document copies that can be sorted out. This contrasts with the limited number of copies that can be sorted out by a mechanical server.

As described above, according to the above-described embodiment, the input/output interface 25 serves to receive data from an external device. The page memory 15*c* stores the received image data. The laser printer engine 31 prints the image data onto recording sheets P. The discharge tray 7*c* holds a stack of the recording sheets printed by the laser printer engine 31. The CPU 11 executes the program of FIG. 5 stored in the program memory 13*a* to attain the above-described operation.

Thus, the printer of the present embodiment includes the print engine capable of printing images onto both the front surface and the backside surface of each recording paper P. The printer operates while counting, with the copy counter, the number of printed copies. The odd-numbered copy is printed on the front surfaces of the papers P from the first page to the last page in this order and is discharged facing downwardly. The even-numbered copy is printed on the backside surfaces of the papers P from the last page to the first page in this order and is discharged facing upwardly. Accordingly, in the printed matter finally stacked on the discharge tray, the printed sheets P are stacked as shown in FIG. 8 so that the surfaces, on which images are printed, are alternated in the respective copies. In each copy, print papers P are arranged properly from the first page to the last page in order.

Figure 9:
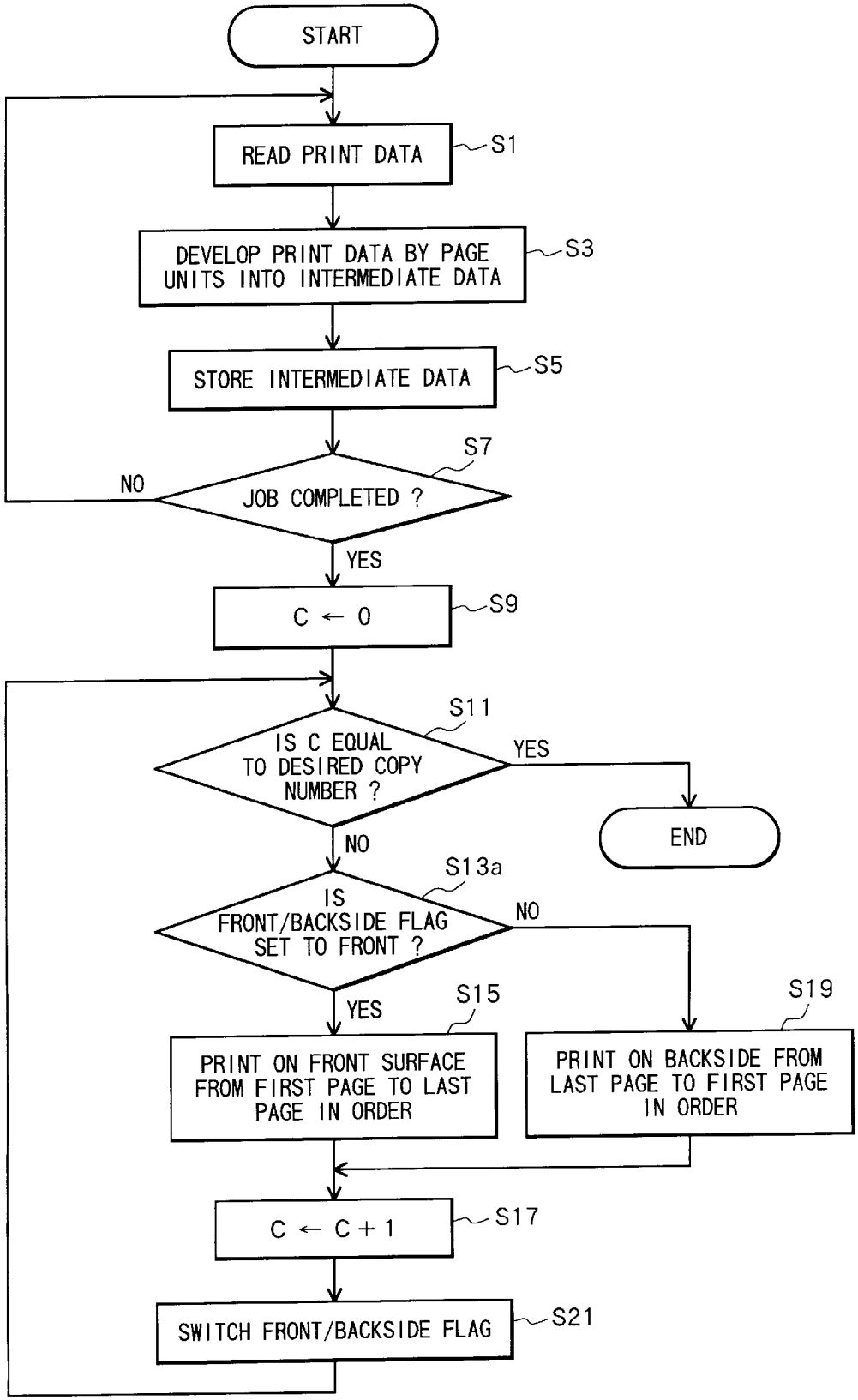
FIG. 9 is a flowchart representing a variation of the control processes of FIG. 5.

Next a modification of the printing processes of FIG. 5 will be provided while referring to FIG. 9.

When a document is printed using the printing processes of FIG. 5, the first document copy will always be printed and discharged to face down. Normally, this type of control is very convenient, especially when a plurality of document copies are printed according to a single set of print data, that is, according to a single job. However, in order to print a single copy each of a plurality of different documents, a plurality of different sets of print data are transmitted to the printer 7 and one document at a time are printed in order according to different sets of print data. In this case, all of the printed documents are printed and discharged to face down on the discharge tray 7*c*, so that the user will have difficulty in separating the different documents from each other.

To avoid this problem, processes represented by the flowchart in FIG. 5 can be modified as shown in FIG. 9. Because the control processes of FIG. 9 are substantially the same as those of FIG. 5, only the different points will be explained. Similar processes are designated by the same step (S) numbering to avoid duplicating description.

The printing processes of FIG. 9 differ from those of FIG. 5 by replacement of the process S13 with another process S13*a*, and the addition of a new process S21 after the process S17. In the process S13*a*, whether the printing processes of S15 or S19 are to be performed is determined based on setting of a front/backside flag. The front/backside flag is automatically set to front when the power of the printer 7 is turned on and switched between front and backside settings each time the process S21 is executed. The condition of the front/backside flag is stored in an appropriate memory region in the work memory 15*b* as long as the power of the printer 7 remains on.

After the control processes of FIG. 9 are started, the print data for a single job is developed into intermediate data and stored according to processes of S1 to S7. Then in S9, the copy number counter C is reset to zero. Afterward, the printing processes are performed in either S15 or S19 according to the condition of the front/backside flag. Each time a document copy is printed in S15 or S19, the program proceeds to S17 and then S21. Because the setting of the front/backside flag is switched each time the process S21 is executed, the recording sheets P of successive document copies are printed and discharged to face down in S15 and to face up in S19 in alternation. When the required number of copies have been completely printed, the process S11 will result in a positive determination, so that these processes are ended.

For this reason, when a plurality of document copies are to be printed according to a single set of print data, the document copies can be printed and discharged to face down in S15 and to face up in S19 in alternation in the same manner as the control processes shown in FIG. 5. After these document copies have been printed according to a single set of print data, the process of FIG. 9 is ended after executing the process of S21 and S11 regardless of the number of printed copies. Accordingly, the front/backside flag is switched in S21 at the end of the print processes. Because the setting of the front/backside flag is maintained until the printer 7 is turned off, the next document printed, even if based on a different set of print data, will be discharged so as to face in a different direction (upward or downward) than the last copy of the previous document. Therefore, even when printing is sequentially executed for a plurality of different sets of print data, images are switched between being printed on the front side and the backside of the sheets alternately with each different document.

For example, when a user wants to print out a single copy of each of a plurality of different documents, he or she controls one or both of the host computers 1, 2 to transmit a plurality of sets of print data, that is, one set for each document, to the printer 7, which switches between printing images on the front side and backside of recording sheets for each set of print data. Accordingly, the user can easily sort, by print data set, the different documents stacked in the discharge tray 7*c* by merely determining whether images are printed on the front side or the backside of the recording sheets P.

Even when the user wants to print out more than one copy of a certain one or ones of the different documents, the user can still easily separate different copies based on whether the images are printed on the front side or the backside of the recording sheet P. Further, the last copy of one document and the first copy of a subsequent different document will be printed with images on differing sides of the recording sheets P. The user can therefore easily separate different documents from each other.

Further, when users of different host computers 1, 2 want to print different documents at nearly the same time, print data sets for these different documents will be transmitted to the printer 7 in succession. In this case also, the different documents are printed with images facing in differing directions, that is, upward facing or downward facing, for different documents. When a plurality of print data sets are consecutively transmitted from a single one of the host computers 1, 2, or when transmitted in alternation from the host computers 1, 2, in either case images will be printed on the front side and the backside of the sheets in alternation for the respective jobs successively transmitted to the printer 7.

Accordingly, when control processes represented by FIG. 9 are executed, printed documents can be easily separated by print data set (i.e., by different documents), by document copy (i.e., from a plurality of copies of the same document), or both. Also, images in each document are stacked according to increasing page number so documents are extremely easy to organize. Further, because no sorter is used in the printer 7, the printer 7 can be made in a compact shape and inexpensively without restrictions to the number of print data sets or document copies that can be printed.

Figure 10:
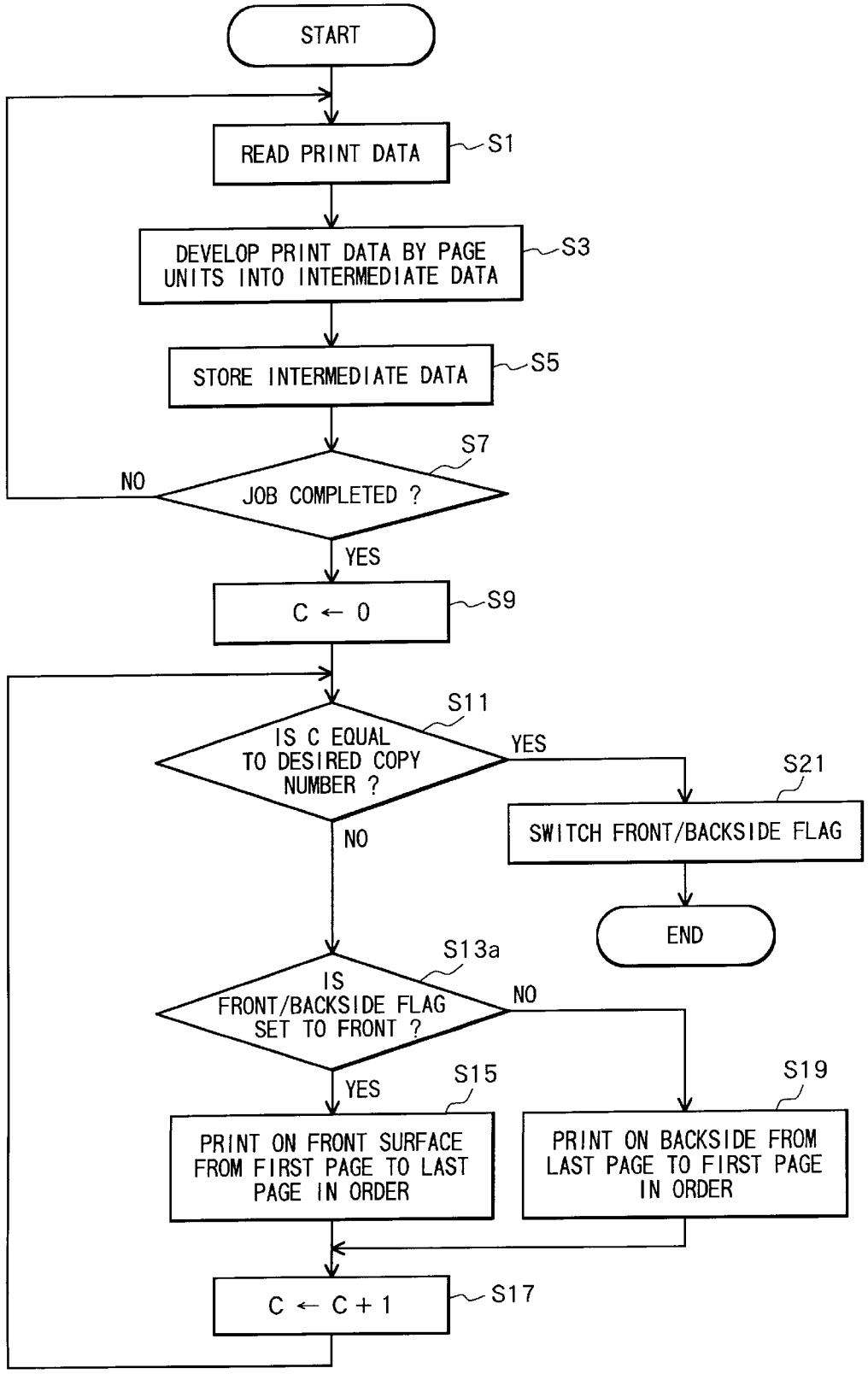
FIG. 10 is a flowchart representing another variation of the control processes of FIG. 5.

Next, a modification of the printing processes of FIG. 9 will be provided while referring to FIG. 10.

When documents are printed according to a plurality of different print data sets (i.e., different documents), a user may want to first separate the different documents (i.e., different print data sets), and then, when a plurality of copies are printed for one or more documents, separate out the different copies of each document. For this reason, the user may possibly wish printing to be switched between front and backside of recording sheets P only for different documents regardless how many copies of each different document are printed. The modification of FIG. 10 enables a user to print documents in this manner.

The printing processes of FIG. 10 differ from those of FIG. 9 in that the process of S21 is provided directly before completion of the program (END).

Accordingly, in the process of FIG. 10, each time printing processes relating to a single print data set, that is, a single job or document, are completed (S11:Yes), then the front/backside flag is inverted in S21 so that printing processes can be switched between face down and face up discharge for successive documents. Contrarily, while documents corresponding to the same print data set are being printed in the required number of copies according to the loop process in S11 to S19, the condition of the front/backside flag will remain the same. For this reason, documents corresponding to a single print data set will all be stacked with the print surface facing the same direction. Accordingly, images can be formed on front side or backside of recording sheets P differently for each print data set, regardless of how many copies are to be made of any one document. In this case, the user can more easily separate different documents printed based on different print data sets.

Next, an explanation for another modification of the printing processes shown in FIG. 9 will be provided while referring to FIG. 11.

The control processes of FIG. 11 are substantially the same as those of FIG. 9, except that a new process S0 is added before the process S1, and the process S21 is performed directly after the process S0.

According to this modification, in S0, it is determined whether or not a print data set just received has been sent from a different host computer than a previous print data set. That is to say, when the source of the present print data set has changed (S0:Yes), then the setting of the front/backside flag is inverted in S21 and the program proceeds to S1. On the other hand, when the source of the print data has not been changed (S0:No), then the program proceeds directly to S1 without changing the setting of the front/backside flag.

With this configuration, documents printed according to print data from the same host computer will always be stacked with the printed surfaces facing the same direction (i.e., up or down) regardless of how many different documents or copies are printed out. For example, when the same one of either host computer 1 or 2 transmits a plurality of different print data sets and images are printed consecutively based on the different print data sets, all the resultant documents may be discharged onto the discharge tray 7*c* with printed surfaces facing in the same direction (i.e., up or down). Accordingly, regardless of how many different documents are received or how many copies are required for each document, printing can be switched between on the front side and the backside of recording sheets P based on the host computer that has sent the print data. As a result, printed documents can be easily separated according to the source host computer.

It should be noted that printing can be switched between on the front side and the backside of recording sheets P based on the source host computer without switching the setting of the front/backside flag each time the source host computer changes. For example, the processes S0 and S21 of FIG. 11 may be replaced with processes for automatically setting the front/backside flag to "front side" whenever the host computer 1 is the source of print data and to "backside" whenever the host computer 2 is the source of print data. According to this control, documents printed based on print data from one host computer (host computer 1, for example) will always be discharged face down and documents printed based on print data from another host computer (host computer 2, for example) will always be discharged face up. Accordingly, the users of the host computers 1, 2 will be able to easily recognize which documents he or she has had printed out.

This control method can be used even when three or more host computers commonly use the same printer 7. For example, host computers can be divided into two groups, and the printer 7 controlled so that documents from one group are always discharged facing up and documents from the other group are discharged facing down. Accordingly, users of host computers in a certain group will be able to easily distinguish between documents for their group and documents for the other group, and will be able to easily retrieve documents for their group.

It should be noted that in the above-described processes of FIGS. 5, 9, 10, and 11, the "top" and "bottom" orientation of images can also be switched when "front side" and "backside" printing is switched. This kind of process can be executed, for example, by omitting processes in S19 for rotating print format (image orientation). In this case, regardless of whether images are formed in S15 or S19, that is, whether recording sheets are discharged to face up or down on the discharge tray 7*c*, the left edges of all recording sheets P will be aligned on one horizontal side and the right edges of all recording sheets P will be aligned on the opposite horizontal side. It should be noted that "left edge" and "right edge" as used here refer to left and right sides of recording sheets with respect to the image formed thereon. In other words, the "left edge" and "right edge" refer to the orientation of the recording sheets when the image formed thereon is viewed. This configuration is convenient when the recording sheets P are originally formed with punch holes in the same left or right edges.

The control processes in each of FIGS. 10 and 11 can be further modified as described below.

Although the "front side" and "backside" printing is switched according to source host computer or print data set (document) as described above, in addition to this, the orientation of images is changed for each copy of a plurality of copies of the same document. More specifically, all copies of the same document are printed on a set one of the "front side" and "backside" of recording sheets. Similarly, all copies of the documents from the same source are printed on a set one of the "front side" and "backside" of recording sheets. The "top" and "bottom" orientation of images is, however, alternated for the respective copies.

To achieve this modification, the print format rotating processes (image orientation inversion process) are eliminated from the process of S19, and a process for switching an image rotation flag is inserted directly after the process of S17. In each of S15 and S19, it is determined whether or not to execute the print format rotating processes based on the setting of the image rotation flag. When it is determined to execute the print format rotating processes based on the image rotation flag setting, the image format rotating process is executed.

With this configuration, each time a copy of a document is printed in one of S15 and S19, the image rotation flag will be switched so that the next copy is printed in the same one of S15 and S19 with a different image orientation. In each of S15 and S19, the image rotation process is performed when the image rotation flag is presently being set to perform the image rotation process.

According to this control process, a user can easily distinguish between sheets from different source computers or for different documents by determining whether images are printed on the front side or the backside of the recording sheets P (i.e., facing upward or downward) and can easily distinguish between different copies of the same document by determining the orientation of the images. Accordingly, documents can be even more easily organized.

Figure 12:
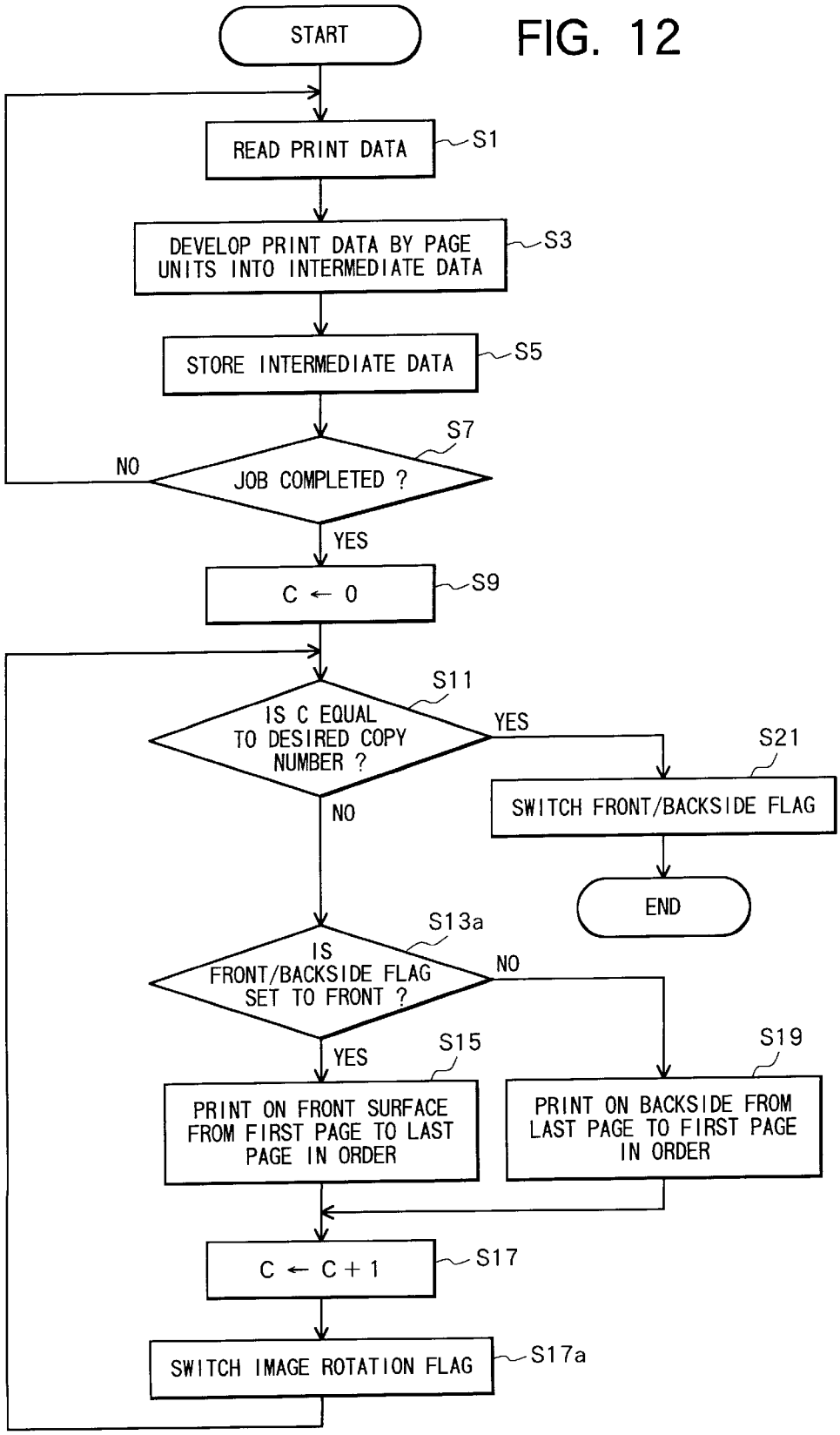
FIG. 12 is a flowchart representing still another variation of the control processes of FIG. 5.

More specifically, according to the above-described modification, the process of FIG. 10, for example, may be modified as shown in FIG. 12.

In this case, each time a copy for the same document is printed in one of S15 and S19, the image rotation flag will be switched in S17*a* so that the next copy is printed in the same one of S15 and S19 with a different image orientation. According to this control process, even when copies for the same document are printed on the same surface of the recording sheets P, those different copies can still be easily distinguished according to the orientation of the images formed thereon.

Figure 13A:
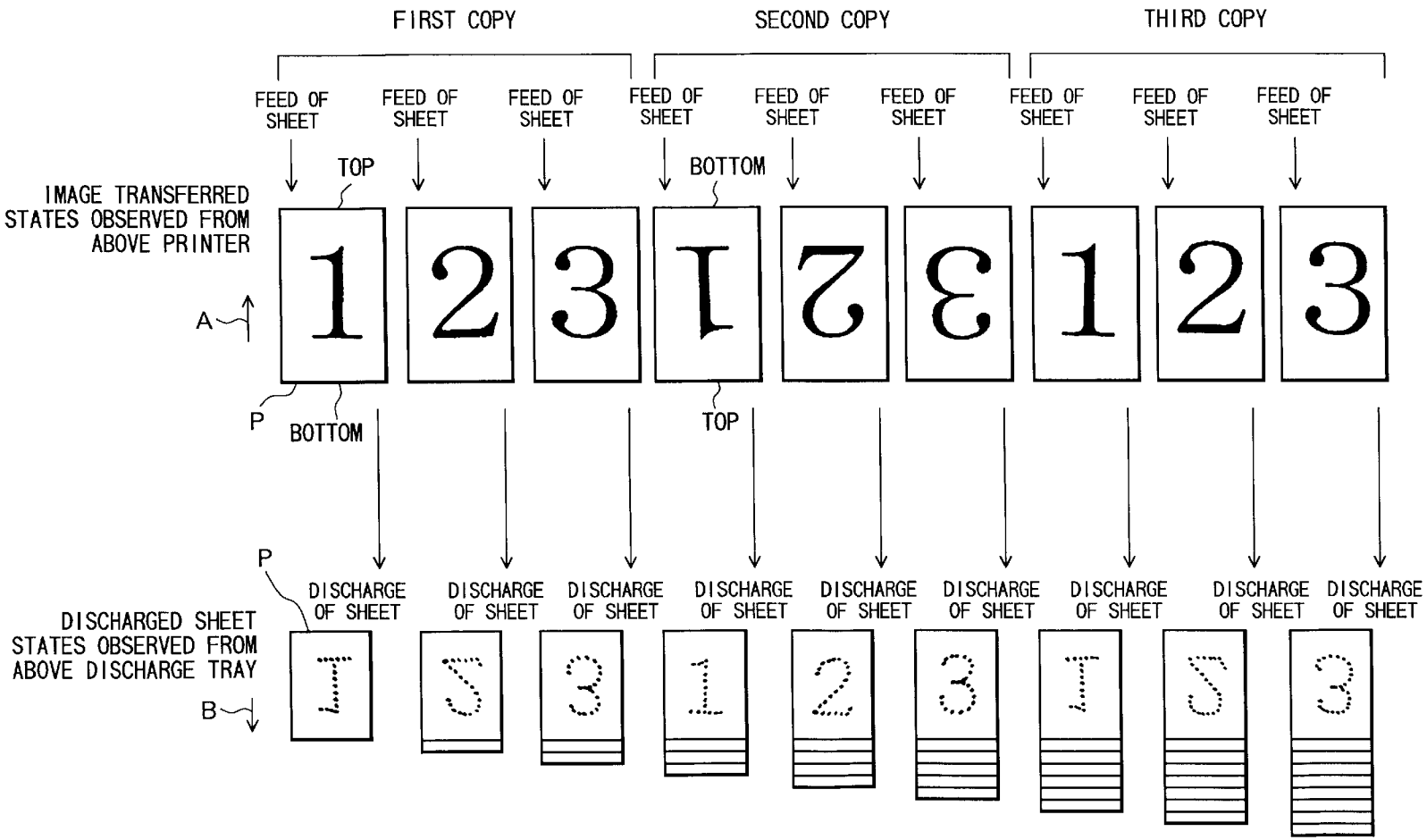
FIG. 13*a* is a schematic view showing how recording sheets are printed, transported, discharged, and stacked in the manner shown in FIG. 12.
Figure 13B:
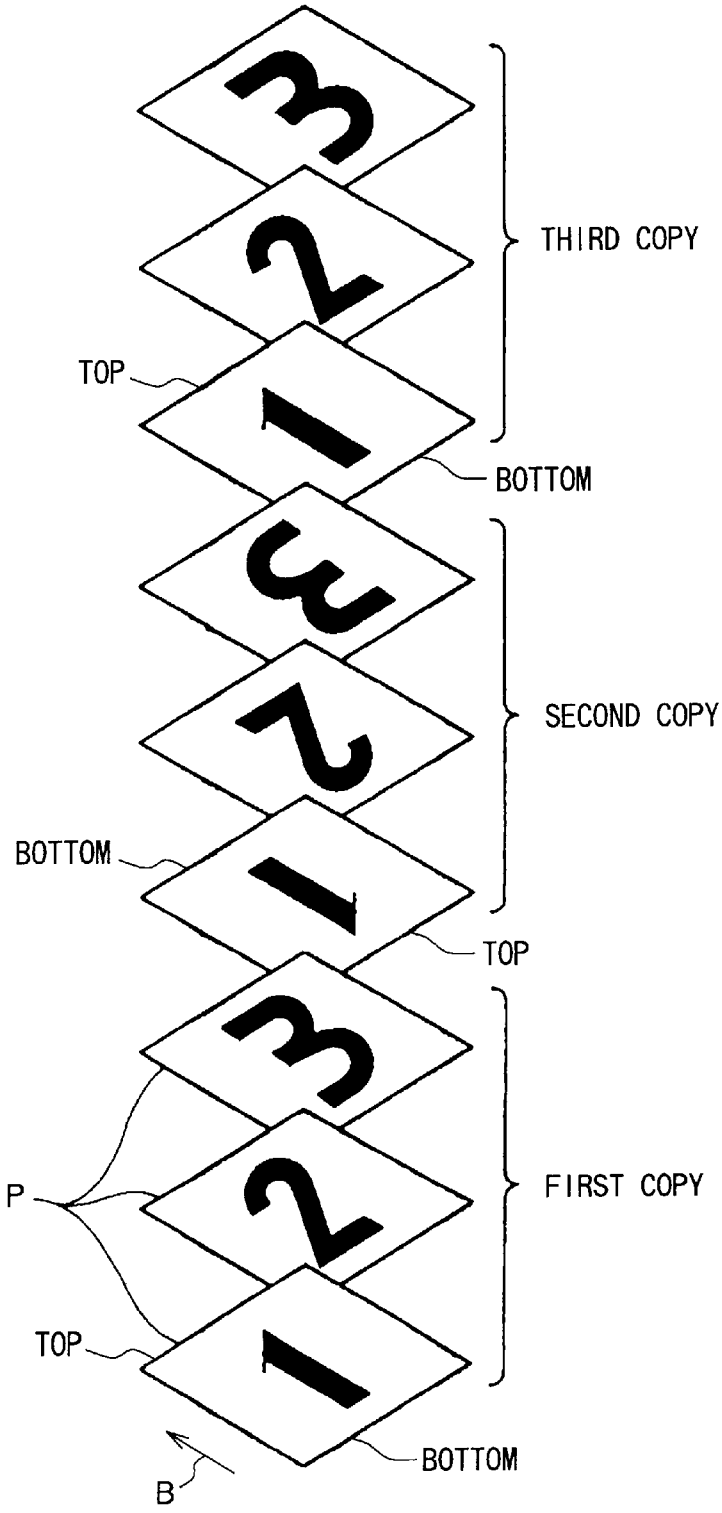
FIG. 13*b* is a schematic view showing stacked condition of sheets printed in the manner shown in FIG. 12 after being discharged from the laser printer of FIG. 4.

For example, when three copies of the same three page document are printed in the process of FIG. 12, the three copies are printed and transported as shown in FIG. 13*a*, and stacked on the discharge tray 7*c* as shown in FIG. 13*b*. More specifically, images for all the copies are printed on the same surface of the recording sheets P. The image rotation process is executed at every other copy. Accordingly, the "top" and "bottom" orientation of the images is switched between the respective copies. More specifically, as shown in FIG. 13*a*, during the printing processes for the first and third copies (odd-numbered copies), each page is recorded on a recording sheet P so that the top of each page image is disposed at the forward edge of the recording sheet P in the sheet feeding direction A. During the printing processes for the second copy (even-numbered copy), each page is recorded on a recording sheet P so that the top of each page image is disposed at the rear edge of the recording sheet P in the sheet feeding direction A. As a result, as shown in FIG. 13*b*, though the printed surfaces of all the three document copies face in the same direction (downward direction in this example), the orientations of the images printed on the three document copies are changed alternately. That is, the top of each page image printed on the first and third document copies are disposed at the forward edge of the recording sheets P with respect to the discharge direction B. The top of each page image printed on the second document copy are disposed at the rear edge of the recording sheets P with respect to the discharge direction B.

Next, a modification of the printing processes of FIG. 11 will be described below.

The printing processes of FIG. 11 can be modified so that, in addition to switching whether images are printed on the front side or the backside of recording sheets P according to the host computer, orientation of images can be switched simply for each different print data set, regardless of the number of copies of each document are to be printed.

To achieve this modification, the process of S17*a* for switching the setting of the image rotation flag is performed directly before completion of the program (END) in FIG. 11. In each of S15 and S19, the print format rotation processes are selectively executed based on the setting of the image rotation flag in the same manner as described above.

According to this modification, the print format rotation processes are either performed or not in each of S15 and S19 based on the setting of the flag. In this case, documents separated by the host computer can also be easily separated based on print data set.

As described above, orientation of images can be switched in various manners. For example, orientation of images may be switched for each copy. Or, orientation of images can be switched for every set of print data, while switching whether the images are printed on the front side or the backside of recording sheets is performed according to each copy. Or, switching whether the images are printed on the front side or the backside of recording sheets may be performed according to both each copy and each set of print data. Only image orientation may be switched for every image data set and for every copy. In addition, printing may be successively executed from the first page to the last page in order even when the printing is performed onto the backside surface so that the printed sheets will be stacked on the discharge tray 7*c* with the printed surfaces facing upwardly. Similarly, printing may be successively executed from the last page to the first page in order even when the printing is performed onto the front side surface so that the printed sheets will be stacked on the discharge tray 7*c* with the printed surfaces facing downwardly. Even in those cases, the printed sheets P can be easily separated by every print data set and by every copy.

When a plurality of copies of the same document are to be printed, the following striking effects can be achieved by switching image orientation for each copy in addition to at least switching between "front" and "backside" printing according to print data set. In this case, the printed recording sheets P can be separated according to print data set and to copy based on a differing characteristic, that is, "front side" and "backside" printing or on image orientation. For this reason, printed documents can be easily separated by print data sets regardless of the number of copies printed for each print data set. After a user prints out documents for a plurality of print data sets, he or she usually first separates documents based on the different print data sets and then sorts out the different copies of each document. According to the above-described configuration, the user can easily separate documents according to print data sets regardless of the number of document copies printed for each print data set. Further, the individual document copies for each print data set are also easily separated, so that organizing documents is extremely convenient.

Through the above-described various printing manners, it becomes possible for a user to easily separate, from one another, image-printed sheets according to various attributes, such as copies, image data sets, and external devices that have sent image data, without making the image forming device large in size and expensive.

Further, the following control becomes possible when the device according to the above-described embodiment is used in combination with a switching device for switching orientation of sheets between their lengthwise sides and their widthwise sides for each document copy, or with a conventional sorter including a plurality of discharge trays. Sheet discharge tray or sheet orientation can be switched according to host computer, "front side" and "back side" can be switched between according to print data set (using printing processes of FIG. 10), and image orientation can be switched according to document copy. In this case, the user first separates printed documents by source host computer, then by print data set, then finally by copy, assuming a plurality of copies of one or more documents is printed. Separation processes are extremely simple in this case. It should be noted that these different characteristics, that is, "front side" and "backside" printing, orientation of sheets P, and orientation of images on the sheets, can be used all together or optionally in any two combination, or even with other characteristics that facilitate ease of sorting, depending on the environment in which the printer is used.

In each of the above-described control processes, when a plurality of copies are to be printed for a single document, all pages, that is, from the first page up or from the last page down, of each copy are printed at the same time in either S15 or S19. All copies of the document are printed by repeating the loop processes of S11 to S19 several times according to the required number of copies. This printing method is termed sort printing. However, the printing processes of FIGS. 10 and 11 can be modified to perform stack printing, wherein a certain page, for example, the first or last page, of the document is first printed in the desired number of copies. Then another page, and another, until all pages are printed in the desired number of copies. In this case, also operations for separating documents by print data set or host computer can be easily performed.

Further, although the printer 7 of the embodiment includes the laser printer engine 31, which is capable of performing duplex printing, the image forming device according to the present invention can be of any type of image forming device that can selectively discharge sheets face up or face down on a discharge tray. For example, even if the printer is of a type that is only capable of performing simplex printing, that is, is only capable of printing on one surface of recording sheets, the present invention can be achieved if sheet discharge can be selectively executed to change whether the sheets face upward or downward when on the discharge tray. In this case, sorting can be very easily performed by switching between face down discharge and face up discharge because this is the same as switching whether the image is printed on a front side or back side of sheets.

It is noted, however, that because the laser printer engine 31 of this example can perform duplex printing operation, that is, can print images on both surfaces of the printing sheets P, a duplex printing can be performed through each of the above-described control processes.

Figure 14:
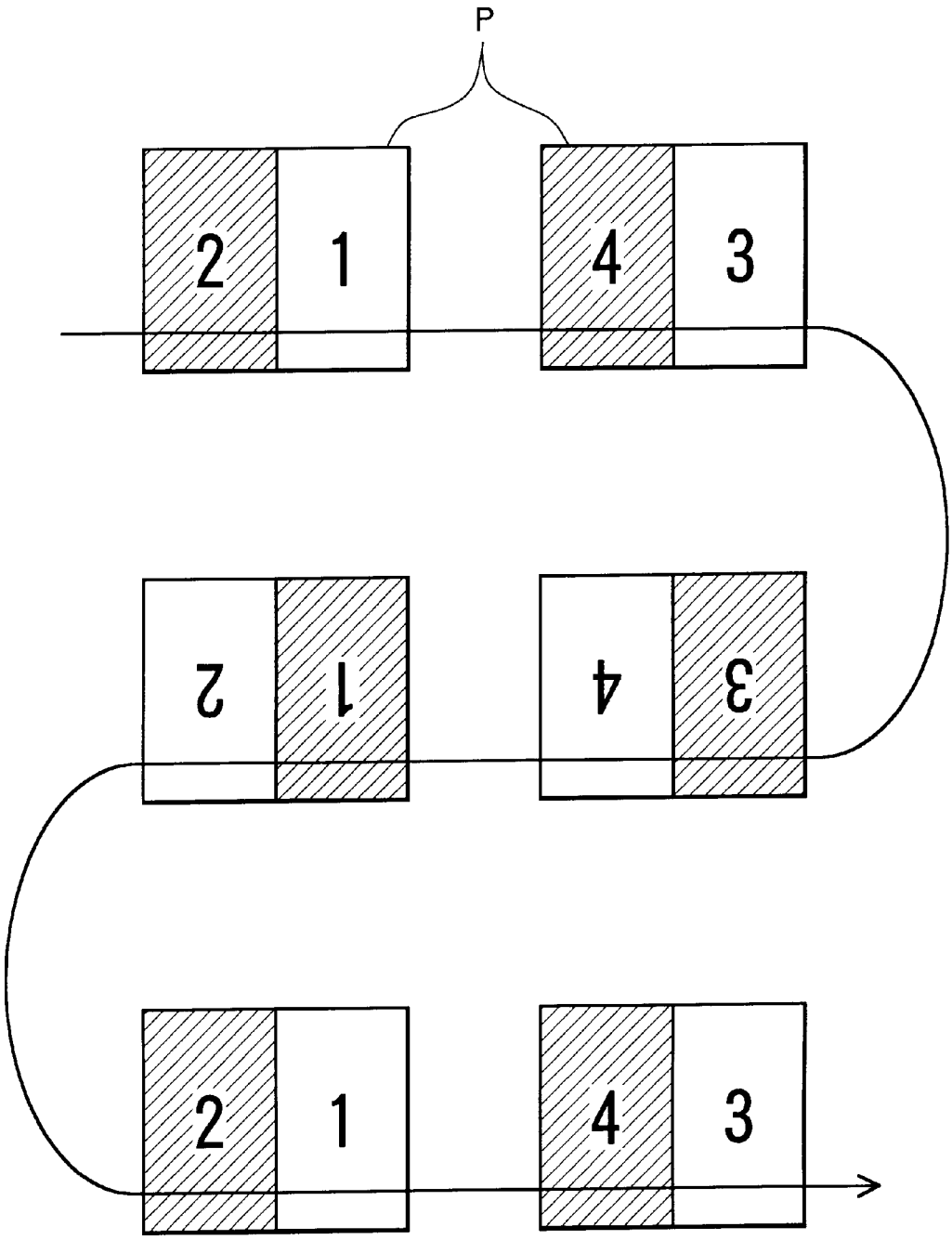
FIG. 14 is a schematic view showing how sheets appear when printed on by the laser printer of FIG. 4 using duplex printing process.

FIG. 14 is a schematic view representing an example of when three copies of the same four page document are printed using a duplex printing according to the control process shown in FIG. 5, wherein duplex printing is performed in each of the printing processes of S15 and S19.

The first copy of the document is printed in S15 in a manner described below.

Figure 15:
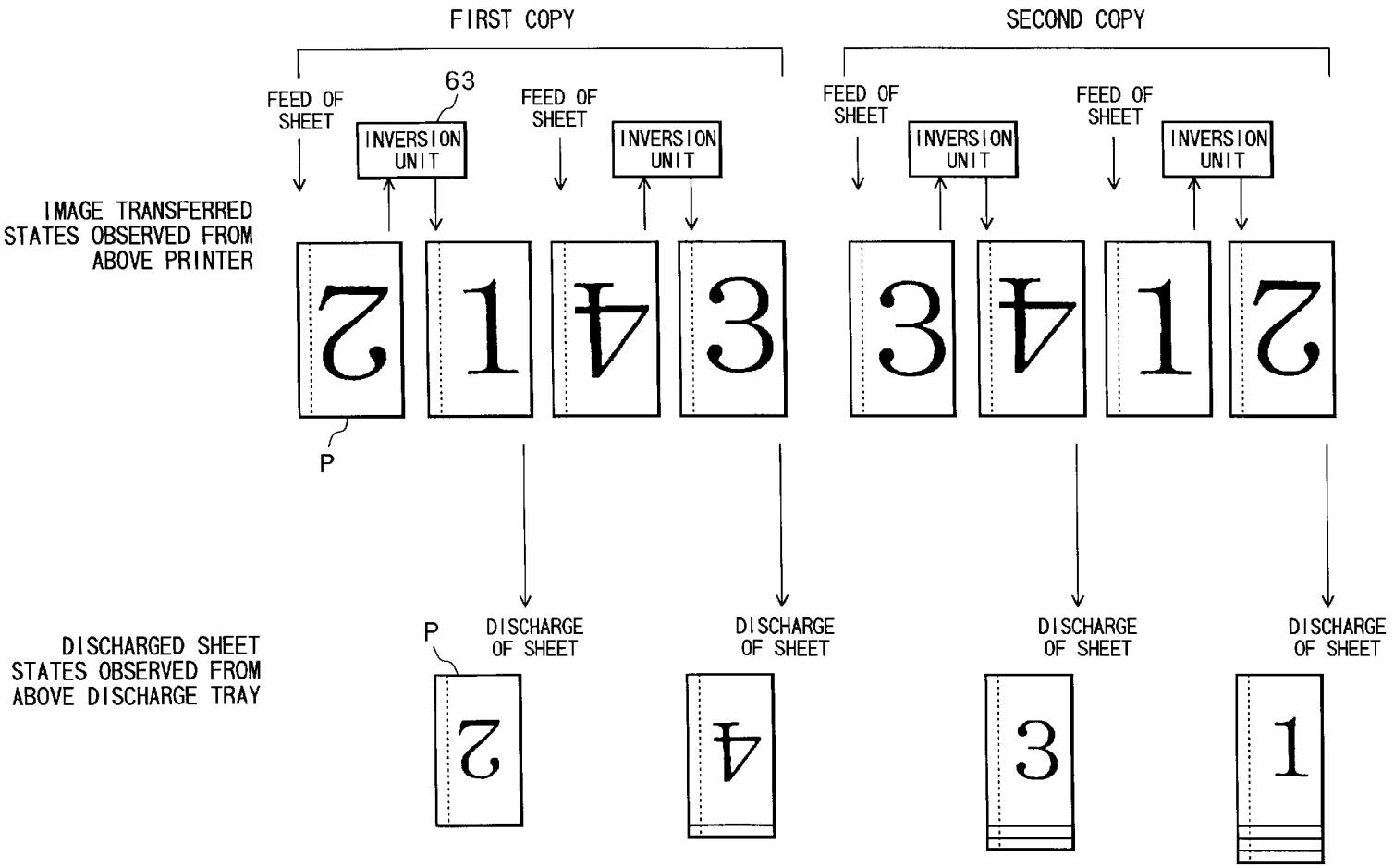
FIG. 15 is a schematic view showing how recording sheets are printed, transported, discharged and stacked in the manner shown in FIG. 14.

First, the second page of the document is printed on one side of a first recording sheet P using the image forming unit 35 as shown in FIG. 15. In this case, the above-described print format rotation process is executed to invert orientation of the second page image.

Next, the recording sheet P is turned over by the inversion unit 63. Then, the first page of the document is printed on the other side of the first recording sheet P using the image forming unit 35. At this time, the print format rotation process is not executed. Afterward, the recording sheet P is directly discharged on the discharge tray 7*c*.

Next, the fourth page of the document is printed on one side of a second recording sheet P. In this case also, the print format rotation process is executed to invert orientation of the fourth page. Afterward the recording sheet P is turned over. Then, the third page is printed on the other side of the second recording sheet P. At this time, the print format rotation process is not executed. The second recording sheet is then directly discharged onto the tray 7*c*.

As a result, the first recording sheet is disposed beneath the second recording sheet on the discharge tray 7*c*. The first page printed on the first recording sheet faces downward and the second page faces upward. The second recording sheet is stacked on top of the first recording sheet on the discharge tray 7*c*. The third page printed on the second recording sheet P faces downward and the fourth page faces upward as shown in FIG. 15.

Afterward when the program reaches S19 via the processes of S17, S11 and S13, duplex printing is performed for the second copy of the document in a manner as described below.

First, the third page of the document is printed on one side of a third recording sheet P as shown in FIG. 15. In this case, the print format rotation process is not executed. The recording sheet P is turned over by the inversion unit 63. Then, the fourth page of the document is printed on the other side of the third recording sheet P. At this time, the print format rotation process is executed to invert orientation of the fourth page. Afterward, the recording sheet P is directly discharged on the discharge tray 7*c*. Thus, the third and fourth pages are printed on both sides of the third recording sheet P.

Next, the first page of the document is printed on one side of a fourth recording sheet P. In this case, the print format rotation process is not executed. Afterward the recording sheet P is turned over. Then, the second page is printed on the other side of the second recording sheet P. At this time, the print format rotation process is executed to invert orientation of the second page. The fourth recording sheet is then directly discharged onto the tray 7*c*. Thus, the first and second pages are printed on both sides of the fourth recording sheet.

As a result, the third sheet, that is, the first sheet of the second copy, is stacked on the discharge tray 7*c* on top of the two sheets of the first copy of the document. The third sheet is disposed with the fourth page image facing down and the third page image facing up. The fourth sheet, that is, the second sheet of the second copy, is stacked on the third sheet with the second page facing down and the first page facing up as shown in FIG. 15.

Finally, the program returns to S15 and performs duplex printing to print the third copy of the document in the same manner as the first copy. As a result, the fifth sheet is disposed on the fourth sheet with the first page facing down and the second page facing up. The sixth sheet is stacked on the fifth sheet with the third page facing down and the fourth page facing up.

For this reason, even when duplex printing is performed, the first and third copies, that is, the odd numbered copies, can be printed and discharged face down, and the second copy, that is, the even numbered copy, can be printed and discharged face up. Further, all of the different document copies are printed with images in the order of increasing page number. Accordingly, sorting by document copy is as easy as described above for simplex printing. Also, organization of documents is very convenient. Further, all the above-described control processes of FIGS. 5–12 can be applied for when duplex printing is performed and the same striking effects can be achieved as when simplex printing is performed.

According to the above-described duplex printing processes, as shown in detail in FIG. 15, image orientation is switched at the same time as backside and front side printing is switched. That is, not only backside or front side printing but also image orientation is switched for each copy. Separation of copies becomes very easy. This is also very convenient when punch holes and the like are previously formed in either the left edge or the right edge of the recording sheet P.

It is noted, however, that image orientation may not be switched for each copy. Image orientation can be aligned in the same orientation for all of the copies if the print format rotation process is executed for printing the third and first pages during the duplex printing processes in S19.

It is also very beneficial to perform duplex printing during the printing processes of FIGS. 14 and 15 when holes are originally formed in the left or right edges of recording sheets P.

The following processes can be performed when it is necessary to distinguish between back side and front side of the recording sheet P.

Figure 16:
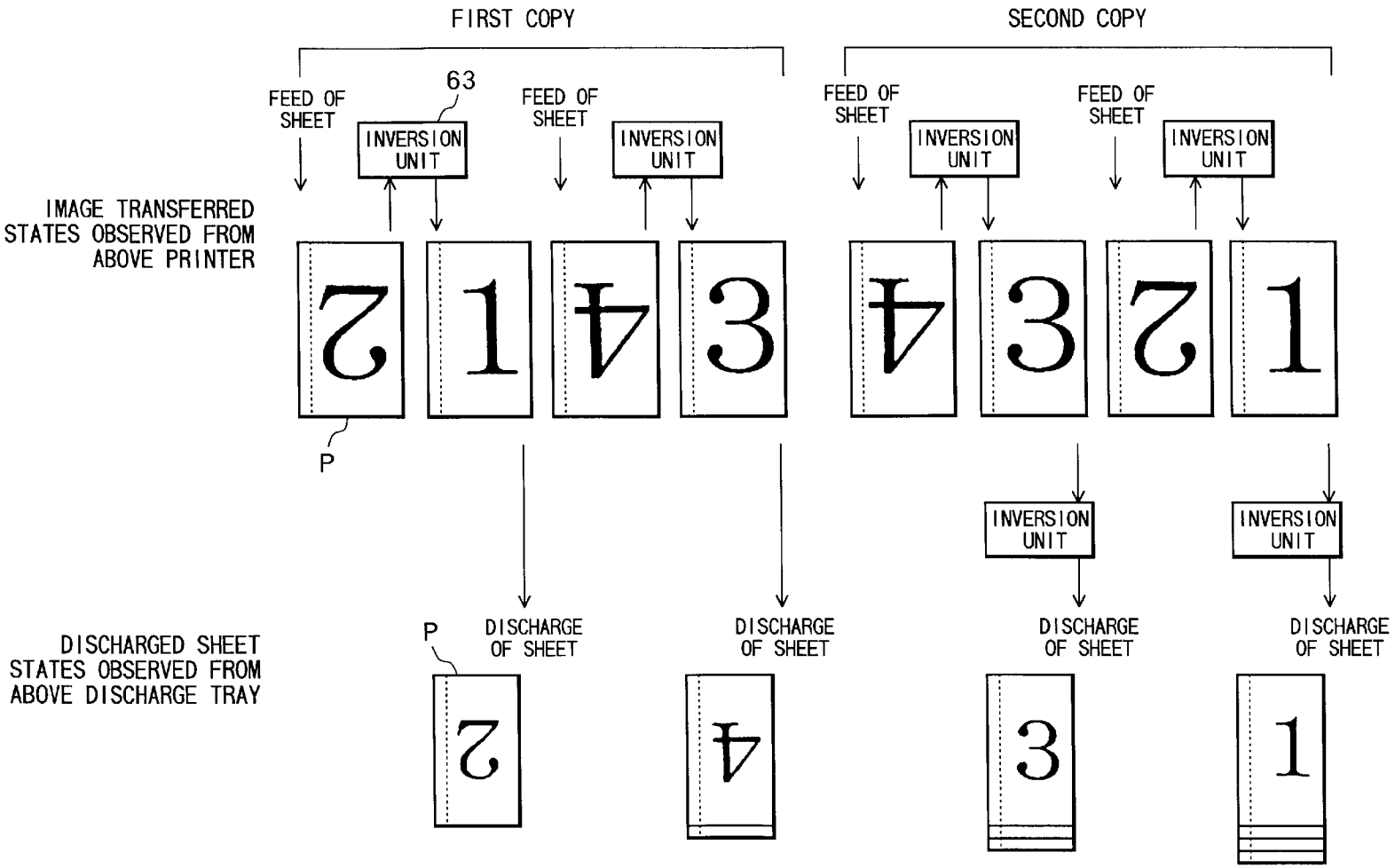
FIG. 16 is a schematic view showing how recording sheets are printed, transported, discharged, and stacked according to another modification of the duplex printing process.

As shown in FIG. 16, when printing the second document copy, that is, the even document copy, duplex printing is performed in the order of the fourth page, the third page, the second page, and the first page, wherein the printing format rotation process is performed when printing the fourth and second pages. Further, after the third and the first pages have been printed, the recording sheet is once transported to the inversion unit 63 without being discharged. After the recording sheet P has been turned over, it is passed through the transport path to the image forming unit 35 without the image forming unit 35 operating and discharged out of the printer 7.

The printing operations of FIG. 16 can be employed when it is required to print each page image on a predetermined side surface with a predetermined orientation. These printing operations are beneficial when each recording sheet P is originally formed with holes in its predetermined side edge and is originally printed with logo marks or other symbols or characters on a predetermined side surface.

While the invention has been described in detail with reference to the specific embodiment thereof, it would be apparent to those skilled in the art that various changes and modifications may be made therein without departing from the spirit of the invention, the scope of which is defined by the attached claims.

For example, the recording sheet P need not be a paper sheet but can instead be any film or any sheet-shaped object.

Instead of the laser printer engine 31, an ink jet or thermal jet print engine could be used instead.

The printer may be modified such that one of the above-described variety of control processes of FIGS. 5–16 could be freely selected by the user according to the environment in which the printer is used. In this case, normal printing can also be selected so that printing can be performed without switching the front side or back side of the recording sheet or without changing orientation of images as desired by the user.

The laser printer engine 31 is of a type that transports the elongated recording sheet P in its lengthwise direction. However, the printer can be designed to transport sheets in their widthwise direction. In this case, a portion of the control processes, such as the print format rotation processes, may be changed as convenience dictates.

What is claimed is:

1. An image forming device, comprising:

an image data storage memory storing image data;

an image forming/discharging section capable of performing an image forming/discharging operation to form images, based on a set of image data stored in the image data storage memory, onto one or more image recording medium, and to discharge the image-formed one or more image recording medium selectively in either one of a face-down discharging condition and a face-up discharging condition, thereby producing a document stack in the corresponding one of the face-down discharging condition and the face-up discharging condition;

a discharge tray capable of holding the produced document stack;

an indication unit that indicates a discharging condition of a document stack to be produced during a present image forming/discharging operation;

an image forming/discharging control unit that controls, when the indication unit indicates the face-down discharging condition for the present image forming/discharging operation, the image forming/discharging section to successively form one or more page's worth of image onto one or more image recording medium with a set of image data in an order from a first page to a last page and discharge the image-formed one or more image recording medium in the face-down discharging condition to thereby produce one document stack in the face-down discharging condition, and that controls, when the indication unit indicates the face-up discharging condition for the present image forming/discharging operation, the image forming/discharging section to successively form one or more page's worth of image onto one or more image recording medium with the set of image data in a reversed order from a last page to a first page and discharge the image-formed one or more image recording medium in the face-up discharging condition to thereby produce one document stack in the face-up discharging condition; and an automatic switching unit that automatically selectively switches the discharging condition indicated by the indication unit from the present discharging condition into the other discharging condition after the image forming/discharging section completes performing the present image forming/discharging operation and before the image forming/discharging section starts performing the next image forming/discharging operation.

2. An image forming device, comprising an image data storage memory storing image data;

an image forming/discharging section capable of successively producing one or more copy document stack by forming images, based on each set of image data stored in the image data storage memory, while selectively switching an orientation of the image between a first orientation and a second orientation, and capable of discharging each of the produced one or more copy document stack selectively in either one of a face-down condition and a face-up condition;

a discharge tray holding the discharged one or more copy document stack;

a discharging condition indication unit that indicates whether one or more copy document stack to be produced based on a single set of image data is to be discharged in the face-down condition or the face-up condition during a present image forming/discharging operation;

an orientation indication unit that indicates whether the images are to be formed in the first orientation or the second orientation during the present image forming/discharging operation;

an image forming/discharging control unit that controls the image forming/discharing section to perform the present image forming/discharging operation to produce the one or more copy document stack, based on the image data, by forming the images in the indicated one of the first orientation or the second orientation and to discharge the produced one or more copy document stack in the indicated one of the face-down condition or the face-up condition;

a first switching unit that performs at least one of a first switching operation to switch the indicated content of the discharging condition indication unit and a second switching operation to switch the indicated content of the orientation indication unit every time the image forming/discharging section completes producing each of the one or more copy document stack during the present image forming/discharging operation;

a second switching unit that performs at least one of the first switching operation and the second switching operation when the image forming/discharging section completes producing all of the one or more copy document stack, whereby when the image storage memory stores a plurality of sets of image data in succession, the image forming/discharging control unit controls the image forming/discharging section to form a plurality of groups of different copy document stacks based on the plurality of sets of image data, while the second switching unit performs, for the respective copy document stack groups, at least one of the first switching operation for switching the discharging condition between the face-down condition and the face-up condition and the second switching operation for switching an orientation of the image to be formed on the image recording medium between the first orientation and the second orientation, the image forming/discharging control unit controlling the image forming/discharging section to form a plurality of copies onto image recording medium based on each of at least one set of the plurality of sets of image data, thereby producing a plurality of copy document stacks, while the first switching unit performs, for the respective copy document stacks, at least one of the first switching operation and the second switching operation.

3. An image forming device, comprising:

a discharging state indication unit that indicates a discharging state in either one of a plurality of discharging states;

an image forming section capable of forming an image onto a sheet;

a sheet transfer section capable of transferring the image-formed sheet to discharge the image-formed sheet in either one of the plurality of discharging states;

a controller that controls the image forming section and the sheet transfer section, during a present image forming/discharging operation, to form an image-formed sheet and discharge the image-formed sheet in the discharging state indicated by the discharging state indication unit; and a changing unit that automatically changes the discharging state of the image-formed sheet indicated by the discharging state indication unit after the image forming section and the sheet transfer section complete performing the present image forming/discharging operation using a set of image data that is supplied from an external device and before the image forming section and the sheet transfer section start performing the next image forming/discharging operation using at least one of: the same set of image data, a different set of image data, and a different set of image data that is supplied from a different external device.

4. An image forming device as claimed in claim 1, wherein the automatic switching unit automatically switches the discharging condition from the present discharging condition into the other discharging condition after the image forming/discharging section completes performing the present image forming/discharging operation and before the image forming/discharging control unit controls the image forming/discharging section to start performing the next image forming/discharging operation with a set of image data that is the same as the set of image data used during the present image forming/discharging operation, thereby allowing the image forming/discharging control unit to control the image forming/discharging section to form one or more stack of copy document using the same image data in an alternately-changed discharging condition between the face-down discharging condition and the face-up discharging condition.

5. An image forming device as claimed in claim 4, wherein the image forming/discharging control unit controls the image forming/discharging section to form one or more stack of copy document by using the same image data during one or more image forming/discharging operation, and wherein the automatic switching unit includes:

a detection unit that detects every time when the image forming/discharging section completes performing the image forming/discharging operation to produce one stack of copy document; and a changing unit that changes the discharging condition from the present discharging condition into the other discharging condition every time the detection unit detects that the image forming/discharging section completes performing the image forming/discharging operation to produce one stack of copy document.

6. An image forming device as claimed in claim 5, further comprising a counter that counts the total number of copy document stacks already produced for the same image data, wherein the detection unit increments the counter every time the image forming/discharging section completes performing the present image forming/discharging operation to produce one stack of copy document, and wherein the changing unit includes:

a judging unit judging whether the total number of copy document stacks is either an even number or an odd number; and a setting unit that sets, when the judging unit judges that the total number of copy stacks is an even number, the discharging condition of the copy document stack to be produced by the next image forming/discharging operation to one of the face-up condition and the face-down condition, and that sets, when the judging unit judges that the total number of copy document stacks is an odd number, the discharging condition of the copy document stack to be produced by the next image forming/discharging operation to the other one of the face-up condition and the face-down condition.

7. An image forming device as claimed in claim 6, wherein the image forming/discharging control unit controls the image forming/discharging section to produce a plurality of stacks of copy document using the same image data, wherein the automatic switching unit automatically switches the discharging condition from the present discharging condition into the other discharging condition every time the image forming/discharging section completes performing one image forming/discharging operation to produce one of the plurality of stacks of copy document, whereby the image forming/discharging control unit controls the image forming/discharging section to form the plurality of copies of the same image data onto image recording medium thereby producing the plurality of copy document stacks, while switching the discharging condition for the respective copy documents, between the face-down discharging condition and the face-up discharging condition.

8. An image forming device as claimed in claim 7, wherein the image forming/discharging control unit controls, when the indication unit indicates that one or more image recording medium, constituting one copy document—for the present image forming/discharging operation, is to be stacked on the discharge tray with the first page facing downwardly, the image forming/discharging section to successively form images with image data in an order from a first page to a last page, and controls, when the indication unit indicates that one or more image recording medium, constituting one copy document for the present image forming/discharging operation, is to be stacked on the discharge tray with the first page facing upwardly, the image forming/discharging section to successively form images with image data in a reversed order from a last page to a first page.

9. An image forming device as claimed in claim 1, wherein the automatic switching unit automatically switches the discharging condition from the present discharging condition into the other discharging condition after the image forming/discharging section completes performing the present image forming/discharging operation using the set of image data and before the image forming/discharging control unit controls the image forming/discharging section to start performing the next image forming/discharging operation with a set of image data that is different from the set of image data used during the present image forming/discharging operation.

10. An image forming device as claimed in claim 9, wherein the image forming/discharging control unit controls the image forming/discharging section to form one or more stack of copy document using the same image data during one or more image forming/discharging operation, and wherein the automatic switching unit includes:

a judging unit that judges whether the image forming/discharging section completes performing the image forming/discharging operation to produce all of the one or more stack of copy document based on the same image data; and a changing unit that changes the discharging condition from the present discharging condition into the other discharging condition when the judging unit judges that the image forming/discharging section completes performing the image forming/discharging operation to produce all of the one or more stack of copy document based on the same image data.

11. An image forming device as claimed in claim 10, wherein the automatic switching unit further includes a detection unit that detects every time when the image forming/discharging section completes performing the image forming/discharging operation to produce one of the one or more stack of copy document based on the same image data, the changing unit further changing the discharging condition from the present discharging condition into the other discharging condition every time the detection unit detects that the image forming/discharging section completes performing the image forming/discharging operation to produce one stack of copy document.

12. An image forming device as claimed in claim 1, wherein the automatic switching unit automatically switches the discharging condition from the present discharging condition into the other discharging condition after the image forming/discharging section completes performing the present image forming/discharging operation with the set of image data that is supplied from an external device and before the image forming/discharging control unit controls the image forming/discharging section to start performing the next image forming/discharging operation with another set of image data that is supplied from another external device that is different from the external device that has supplied the set of image data used during the present image forming/discharging operation.

13. An image forming device as claimed in claim 10, wherein the image storage memory stores a plurality of different sets of image data in succession, and wherein the automatic switching unit automatically switches the discharging condition from the present discharging condition into the other discharging condition after the image forming/discharging section completes performing the present image forming/discharging operation with a single set of image data and before the image forming/discharging section starts performing the next image forming/discharge operation with a different set of image data, the image forming/discharging control unit controls the image forming/discharging section to form a plurality of different document stacks based on the plurality of different sets of image data while switching the discharging condition for the respective sets of image data, between the face-down discharging condition and the face-up discharging condition.

14. An image forming device as claimed in claim 13, wherein the image forming/discharging control unit controls, when the indication unit indicates that each document stack, printed with a corresponding image data set, is to be stacked on the discharge tray with the first page facing downwardly, the image forming/discharging section to successively form images with the image data in an order from a first page to a last page and controls, when the indication unit indicates that each document stack, printed with a corresponding image data set, is to be stacked on the discharge tray with the first page facing upwardly, the image forming/discharging section to successively form images with the image data in a reversed order from a last page to a first page.

15. An image forming device as claimed in claim 11, wherein the automatic switching unit automatically switches the discharging condition from the present discharging condition into the other discharging condition also every time the image forming/discharging section completes performing the present image forming/discharging operation to produce one of the one or more stack of copy document whereby the image forming/discharging control unit controls the image forming/discharging section to form the same image data into image recording medium, thereby producing one or more copy document stack based on each set of image data, while switching the discharging condition for the respective copy, between the face-down discharging condition and the face-up discharging condition.

16. An image forming device as claimed in claim 15, wherein the image forming/discharging control unit controls, when the indication unit indicates that one or more image recording medium, constituting one copy document for the present image forming/discharging operation, is to be stacked on the discharge tray with the first page facing downwardly, the image forming/discharging section to successively form images with image data in an order from a first page to a last page and controls, when the indication unit indicates that one or more image recording medium, constituting one copy document for the present image forming/discharging operation, is to be stacked on the discharge tray with the first page facing upwardly, the image forming/discharging section to successively form images with image data in a reversed order from a last page to a first page.

17. An image forming device as claimed in claim 12, further comprising a receiving unit receiving image data transmitted separately from a plurality of external devices and successively storing the image data in the image storage memory and wherein the automatic switching unit includes:

a maintaining unit that maintains the discharging condition indicated by the indication unit after the image forming/discharging section completes performing the present image forming/discharging operation with the image data supplied from the external device;

a judging unit that judges whether image data to be used for the next image forming/discharging operation is supplied from another external device that is different from the external device that has supplied the image data used during the present image forming/discharging operation; and a changing unit that changes the discharging condition from the present discharging condition into the other discharging condition when the judging unit judges that the image data to be used during the next image forming/discharging operation is supplied from the other external device that is different from the external device that has supplied the image data used during the present image forming/discharging operation whereby the image forming/discharging control unit controls the image forming/discharging section to successively form the image data supplied from different external devices onto image recording medium, thereby producing different document stacks, while switching, between the face-down discharging condition and the face-up discharging condition, the discharging condition for the image data transmitted from the respective external device.

18. An image forming device as claimed in claim 17, wherein the image forming/discharging control unit controls, when the indication unit indicates that each document stack to be produced based on image data from one external device is to be stacked on the discharge tray with the first page facing downwardly, the image forming/discharging section to successively form images with image data in an order from a first page to a last page and controls, when the indication unit indicates that each document stack to be produced based on image data from one external device is to be stacked on the discharge tray with the first page facing upwardly, the image forming/discharging section to successively form images with image data in a reversed order from a last page to a first page.

19. An image forming device as claimed in claim 3, wherein the changing unit includes a first changing unit switching a direction, in which an image-formed surface of the image-formed sheet faces, between a first direction and a second direction.

20. An image forming device as claimed in claim 19, wherein the first changing unit switches the direction between an upward direction and a downward direction.

21. An image forming device as claimed in claim 3, wherein the changing unit includes a second changing unit switching an orientation, in which an image is formed on the image-formed sheet, between a first orientation and a second orientation.

22. An image forming device as claimed in claim 21, wherein the second changing unit selectively switches the orientation between a forward orientation and a reverse orientation.

23. An image forming device as claimed in claim 20, wherein the first changing unit includes a unit selectively controlling the sheet transfer section to turn over the image-formed sheet upside down.

24. An image forming device as claimed in claim 21, wherein the second changing unit includes a unit selectively controlling the image forming section to form an image in one of a predetermined manner and in a manner reversed from the predetermined manner.

25. An image forming device as claimed in claim 3, wherein the plurality of discharging states include a direction, in which the image-formed surface of the image-formed sheet faces, and an orientation, in which the image formed on the image-formed sheet is oriented.

* * * * *